US010381750B2

(12) United States Patent
Jung et al.

(10) Patent No.: US 10,381,750 B2
(45) Date of Patent: Aug. 13, 2019

(54) ELECTRONIC DEVICE

(71) Applicant: LG ELECTRONICS INC., Seoul (KR)

(72) Inventors: Junyoung Jung, Seoul (KR); Seungwoo Ryu, Seoul (KR); Wonwoo Lee, Seoul (KR); Joohee Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/897,203

(22) Filed: Feb. 15, 2018

(65) Prior Publication Data

US 2019/0058264 A1 Feb. 21, 2019

Related U.S. Application Data

(60) Provisional application No. 62/547,058, filed on Aug. 17, 2017.

(30) Foreign Application Priority Data

Nov. 28, 2017 (KR) ..... 10-2017-0160595

(51) Int. Cl.

| | |
|---|---|
| ***H01Q 1/24*** | (2006.01) |
| ***H01Q 1/44*** | (2006.01) |
| ***H01Q 9/04*** | (2006.01) |
| ***H01Q 21/00*** | (2006.01) |
| ***H01Q 21/06*** | (2006.01) |
| ***H01Q 21/24*** | (2006.01) |
| ***H01Q 25/00*** | (2006.01) |

(52) U.S. Cl.

CPC ..... *H01Q 25/001* (2013.01); *H01Q 1/243* (2013.01); *H01Q 1/44* (2013.01); *H01Q 9/0435* (2013.01); *H01Q 21/0006* (2013.01); *H01Q 21/065* (2013.01); *H01Q 21/24* (2013.01)

(58) Field of Classification Search

CPC .... H01Q 25/001; H01Q 1/243; H01Q 21/065; H01Q 9/0435

See application file for complete search history.

(56) References Cited

U.S. PATENT DOCUMENTS 7,847,748 B1 * 12/2010 McKinley ..... H01Q 15/24 343/756

9,531,083 B2 12/2016 Gottl et al.

(Continued)

OTHER PUBLICATIONS

Balanis, "Chapter 14: Microstrip Antennas", In: "Antenna Theory: Analysis and Design", Apr. 4, 2005, John Wiley and Sons, Hoboken, New Jersey, XP055537912, p. 859-865.

*Primary Examiner* — Daniel Munoz

(74) *Attorney, Agent, or Firm* — Birch, Stewart, Kolasch & Birch, LLP

(57) ABSTRACT

An electronic device including a display unit; an array antenna including a transparent electrode material and being disposed within the display unit; and a radio frequency integrated circuit (RFIC) electrically connected to the array antenna. The array antenna includes an antenna element having first and second sides perpendicular to each other disposed slopingly at a predetermined angle with respect to one side of the display unit; and a feeding part connecting the antenna element and the RFIC.

19 Claims, 17 Drawing Sheets

(56) References Cited

U.S. PATENT DOCUMENTS

| | | | | |
|---|---|---|---|---|
| 2011/0298670 | A1* | 12/2011 | Jung | H01Q 1/243 343/702 |
| 2012/0235881 | A1* | 9/2012 | Pan | H01Q 21/20 343/893 |
| 2013/0265203 | A1* | 10/2013 | Ermutlu | H01Q 9/0457 343/703 |
| 2014/0073270 | A1 | 3/2014 | Chou et al. | |
| 2014/0106684 | A1 | 4/2014 | Burns et al. | |
| 2015/0255856 | A1 | 9/2015 | Hong et al. | |
| 2015/0309626 | A1 | 10/2015 | Prendergast et al. | |
| 2017/0285844 | A1* | 10/2017 | Park | G06F 3/0416 |
| 2017/0309991 | A1* | 10/2017 | Noori | H01Q 1/243 |
| 2017/0338571 | A1 | 11/2017 | Moosbrugger et al. | |

* cited by examiner

Theta/Degree vs.dBi

ELECTRONIC DEVICE

CROSS-REFERENCE TO RELATED APPLICATION

Pursuant to 35 U.S.C. § 119(a), this application claims the benefit of the earlier filing date and the right of priority to U.S. Provisional Application No. 62/547,058, filed on Aug. 17, 2017, and Korean Application No. 10-2017-0160595, filed on Nov. 28, 2017, all of which are hereby expressly incorporated by reference into the present application.

BACKGROUND OF THE INVENTION

1. Field of the Invention

The present disclosure relates to an electronic device in which an antenna is provided in a display, and particularly, to an electronic device including an antenna formed of a transparent electrode material in a display unit.

2. Background of the Invention

An electronic device can be divided into a mobile/portable terminal and a stationary terminal. The mobile terminal can also be divided into a handheld terminal and a vehicle mounted terminal.

Such electronic devices (or terminals) have various functions according to the development of technology. For example, an electronic device is implemented in the form of a multimedia device having multiple functions such as capturing an image or video, reproduction of music or a video file, playing a game, and receiving a broadcast. Further, in order to support and enhance functions of the electronic device, improvement of structural parts and/or software part of the electronic device may be considered.

Recently, as electronic devices provide broadband services, the electronic devices are required to operate in a high frequency band. In this connection, in recent years, standardization for $5^{th}$-generation (5G) communication services is underway and, thus, it is necessary to improve electrical performance of an antenna element. However, a printed antenna printed on a circuit board developed so far or a chip antenna disposed on a circuit board has a very high loss in a 5G frequency band (for example, 28 GHz or 39 GHz band).

In addition, electromagnetic waves of an antenna are radiated to a front or rear surface of an electronic device. However, when the rear surface of the electronic device is covered with a palm of a hand, it is difficult for electromagnetic waves to be radiated through the rear surface. Also, radiation to the front surface of the electronic device is difficult to pass through a display.

SUMMARY OF THE INVENTION

Therefore, an aspect of the detailed description is to enhance performance of an antenna formed of a transparent electrode material within a display.

To achieve these and other advantages and in accordance with the purpose of this specification, as embodied and broadly described herein, an electronic device includes a display unit outputting visual information; an array antenna disposed within the display unit and formed of a transparent electrode material; and a radio frequency integrated circuit (RFIC) electrically connected to the array antenna, wherein the array antenna includes: an antenna element in which first and second sides perpendicular to each other are disposed slopingly at a predetermined angle with respect to one side of the display unit; and a feeding part connecting the antenna element and the RFIC.

To achieve these and other advantages and in accordance with the purpose of this specification, as embodied and broadly described herein, an electronic device includes: a display unit divided into an output region in which visual information is output and an opaque bezel region surrounding the output region; an array antenna disposed within the output region and formed of a transparent electrode material; and a radio frequency integrated circuit (RFIC) electrically connected to the array antenna, wherein the array antenna includes: an antenna element; and first and second feeding lines connecting the antenna element and the RFIC in a dual-feeding form and linearly disposed to be parallel to each other.

According to embodiments of the present disclosure, since two sides of the patch antenna perpendicular to each other are slopingly disposed with respect to one side of the display and two feeding lines implementing dual-feeding are linearly disposed to be parallel to each other, feeding loss and radiation loss is reduced.

Also, since two feeding lines are implemented without being bent, isolation characteristics between ports are improved, enhancing radiation performance. In addition, since horizontal/vertical polarization purity is maintained constant, while reducing loss due to dual-feeding of the array antenna, a variation in performance according to a rotational state of the electronic device, or the like, is prevented.

Further scope of applicability of the present application will become more apparent from the detailed description given hereinafter. However, it should be understood that the detailed description and specific examples, while indicating preferred embodiments of the invention, are given by way of illustration only, since various changes and modifications within the scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail according to exemplary embodiments disclosed herein, with reference to the accompanying drawings. For the sake of brief description with reference to the drawings, the same or equivalent components may be provided with the same or similar reference numbers, and description thereof will not be repeated. In general, a suffix such as "module" and "unit" may be used to refer to elements or components. Use of such a suffix herein is merely intended to facilitate description of the specification, and the suffix itself is not intended to give any special meaning or function. The accompanying drawings are used to help easily understand the technical idea of the present disclosure and it should be understood that the idea of the present disclosure is not limited by the accompanying drawings. The idea of the present disclosure should be construed to extend to any alterations, equivalents and substitutes besides the accompanying drawings.

Although the terms first, second, etc. may be used herein to describe various elements, these elements should not be limited by these terms. These terms are generally only used to distinguish one element from another. When an element is referred to as being "connected with" another element, the element can be connected with the other element or intervening elements may also be present. In contrast, when an element is referred to as being "directly connected with" another element, there are no intervening elements present.

A singular representation may include a plural representation unless it represents a definitely different meaning from the context. Terms such as "include" or "has" are used herein and should be understood that they are intended to indicate an existence of several components, functions or steps, disclosed in the specification, and it is also understood that greater or fewer components, functions, or steps may likewise be utilized.

Mobile terminals presented herein may be implemented using a variety of different types of terminals. Examples of such terminals include cellular phones, smart phones, user equipment, laptop computers, digital broadcast terminals, personal digital assistants (PDAs), portable multimedia players (PMPs), navigators, portable computers (PCs), slate PCs, tablet PCs, ultra books, wearable devices (for example, smart watches, smart glasses, head mounted displays (HMDs)), and the like.

By way of non-limiting example only, further description will be made with reference to particular types of mobile terminals. However, such teachings apply equally to other types of terminals, such as those types noted above. In addition, these teachings may also be applied to stationary terminals such as digital TV, desktop computers, and the like.

Figure 1A:
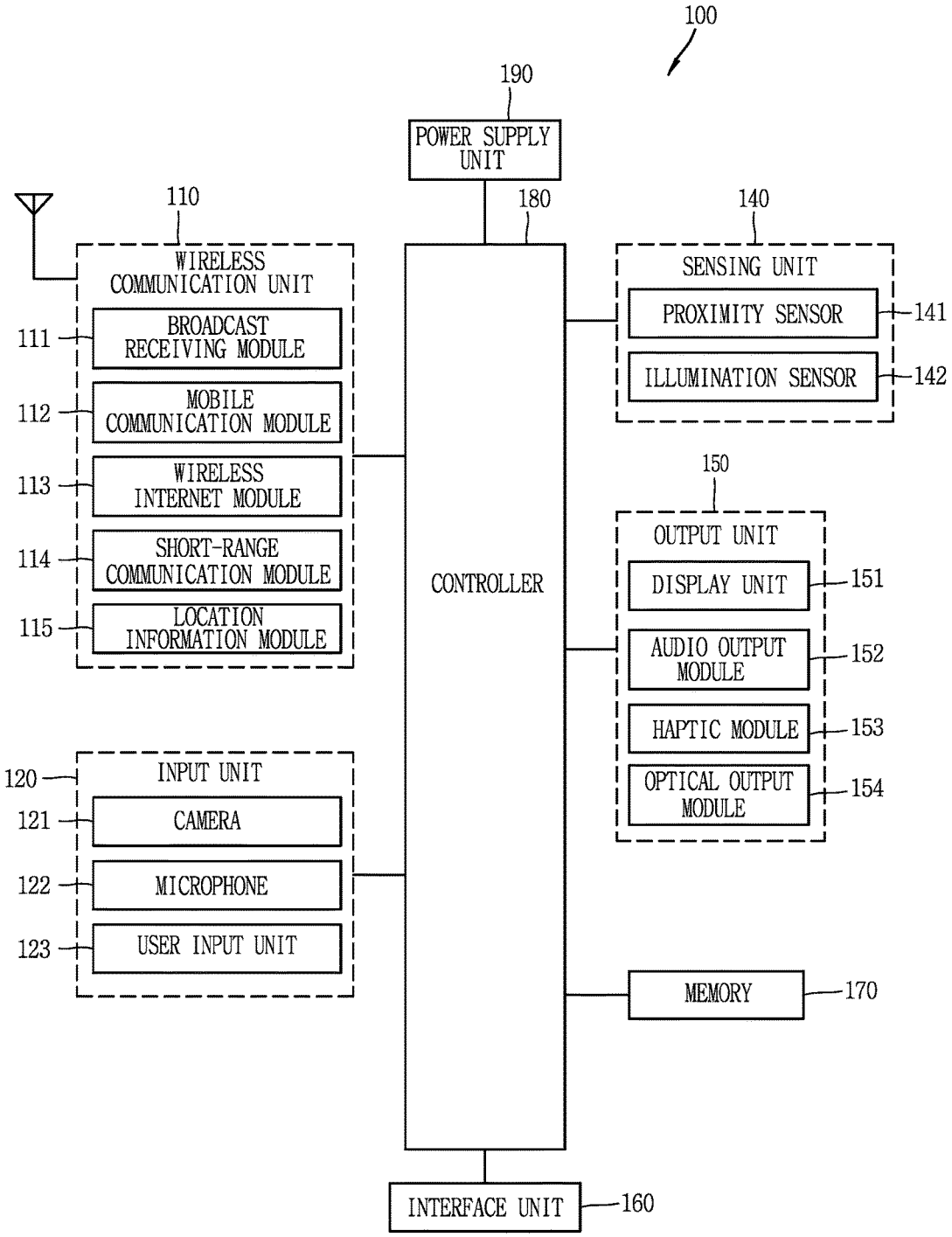
FIG. 1A is a block diagram illustrating an electronic device related to the present disclosure.

FIG. 1A is a block diagram of an electronic device 100 in accordance with the present disclosure. The electronic device 100 may be shown having components such as a wireless communication unit 110, an input unit 120, a sensing unit 140, an output unit 150, an interface unit 160, a memory 170, a controller 180, and a power supply unit 190. FIG. 1 shows the electronic device 100 having various components, but implementing all of the illustrated components is not a requirement. Greater or fewer components may alternatively be implemented.

In more detail, among others, the wireless communication unit 110 may typically include one or more modules which permit communications such as wireless communications between the electronic device 100 and a wireless communication system, communications between the electronic device 100 and another mobile terminal, or communications between the electronic device 100 and an external server. Further, the wireless communication unit 110 may typically include one or more modules which connect the glass type terminal 100 to one or more networks.

The wireless communication unit 110 may include one or more of a broadcast receiving module 111, a mobile communication module 112, a wireless Internet module 113, a short-range communication module 114, and a location information module 115. The input unit 120 may include a camera 121 or an image input unit for obtaining images or video, a microphone 122, which is one type of audio input device for inputting an audio signal, and a user input unit 123 (for example, a touch key, a mechanical key, and the like) for allowing a user to input information. Data (for example, audio, video, image, and the like) can be obtained by the input unit 120, be analyzed and processed according to user commands.

The sensing unit 140 is typically be implemented using one or more sensors configured to sense internal information of the electronic device, the surrounding environment of the electronic device, user information, and the like. For example, the sensing unit 140 may include at least one of a proximity sensor 141, an illumination sensor 142, a touch sensor, an acceleration sensor, a magnetic sensor, a G-sensor, a gyroscope sensor, a motion sensor, an RGB sensor, an infrared (IR) sensor, a finger scan sensor, a ultrasonic sensor, an optical sensor (for example, camera 121), a microphone 122, a battery gauge, an environment sensor (for example, a barometer, a hygrometer, a thermometer, a radiation detection sensor, a thermal sensor, and a gas sensor, among others), and a chemical sensor (for example, an electronic nose, a health care sensor, a biometric sensor, and the like). The electronic device disclosed herein can utilize information obtained from one or more sensors, and combinations thereof.

The output unit 150 is typically configured to output various types of information, such as audio, video, tactile output, and the like. The output unit 150 may be shown having at least one of a display unit 151, an audio output module 152, a haptic module 153, and an optical output module 154. The display unit 151 may have an inter-layered structure or an integrated structure with a touch sensor in order to implement a touch screen. The touch screen may function as the user input unit 123 which provides an input interface between the electronic device 100 and the user and simultaneously provide an output interface between the electronic device 100 and a user.

The interface unit 160 serves as an interface with various types of external devices that are coupled to the electronic device 100. The interface unit 160, for example, may include any of wired or wireless ports, external power supply ports, wired or wireless data ports, memory card ports, ports for connecting a device having an identification module, audio input/output (I/O) ports, video I/O ports, earphone ports, and the like. In some instances, the electronic device 100 can perform assorted control functions associated with a connected external device, in response to the external device being connected to the interface unit 160.

The memory 170 is typically implemented to store data to support various functions or features of the electronic device 100. For instance, the memory 170 can store application programs executed in the electronic device 100, data or instructions for operations of the electronic device 100, and the like. Some of these application programs may be downloaded from an external server via wireless communication. Other application programs may be installed within the electronic device 100 at the time of manufacturing or shipping, which is typically the case for basic functions of the electronic device 100 (for example, receiving a call, placing a call, receiving a message, sending a message, and the like). It is common for application programs to be stored in the memory 170, installed in the electronic device 100, and executed by the controller 180 to perform an operation (or function) for the electronic device 100.

The controller 180 typically functions to control an overall operation of the electronic device 100, in addition to the operations associated with the application programs. The controller 180 can provide or process information or functions appropriate for a user by processing signals, data, information and the like, which are input or output by the aforementioned various components, or activating application programs stored in the memory 170.

Also, the controller 180 can control at least some of the components illustrated in FIG. 1A, to execute an application program that have been stored in the memory 170. In addition, the controller 180 can control a combination of at least two of those components included in the electronic device 100 to activate the application program.

The power supply unit 190 is configured to receive external power or provide internal power in order to supply appropriate power required for operating elements and components included in the electronic device 100. The power supply unit 190 may include a battery configured as an embedded battery or a detachable battery.

At least part of the components can cooperatively operate to implement an operation, a control or a control method of the electronic device 100 according to various embodiments disclosed herein. Also, the operation, the control or the control method of the electronic device 100 can be implemented on electronic device by an activation of at least one application program stored in the memory 170.

Hereinafter, description will be given in more detail of the aforementioned components with reference to FIG. 1A, prior to describing various embodiments implemented through the electronic device 100. First, regarding the wireless communication unit 110, the broadcast receiving module 111 is typically configured to receive a broadcast signal and/or broadcast associated information from an external broadcast managing entity via a broadcast channel. The broadcast channel may include a satellite channel, a terrestrial channel, or both. In some embodiments, two or more broadcast receiving modules may be provided in the electronic device 100 to facilitate simultaneous reception of two or more broadcast channels, or to support switching among broadcast channels.

The mobile communication module 112 can transmit and/or receive wireless signals to and from one or more network entities. Typical examples of a network entity include a base station, an external mobile terminal, a server, and the like. Such network entities form part of a mobile communication network, which is constructed according to technical standards or communication methods for mobile communications (for example, Global System for Mobile Communication (GSM), Code Division Multi Access (CDMA), CDMA2000 (Code Division Multi Access 2000), EV-DO (Enhanced Voice-Data Optimized or Enhanced Voice-Data Only), Wideband CDMA (WCDMA), High Speed Downlink Packet access (HSDPA), HSUPA (High Speed Uplink Packet Access), Long Term Evolution (LTE), LTE-A (Long Term Evolution-Advanced), and the like).

The wireless signal may include various types of data depending on a voice call signal, a video call signal, or a text/multimedia message transmission/reception. The wireless Internet module 113 refers to a module for wireless Internet access. This module may be internally or externally coupled to the electronic device 100. The wireless Internet module 113 can transmit and/or receive wireless signals via communication networks according to wireless Internet technologies.

Examples of such wireless Internet access include Wireless LAN (WLAN), Wireless Fidelity (Wi-Fi), Wi-Fi Direct, Digital Living Network Alliance (DLNA), Wireless Broadband (WiBro), Worldwide Interoperability for Microwave Access (WiMAX), High Speed Downlink Packet Access (HSDPA), High Speed Uplink Packet Access (HSUPA), Long Term Evolution (LTE), LTE-advanced (LTE-A) and the like. The wireless Internet module 113 can transmit/receive data according to one or more of such wireless Internet technologies, and other Internet technologies as well.

When the wireless Internet access is implemented according to, for example, WiBro, HSDPA, HSUPA, GSM, CDMA, WCDMA, LTE, LTE-A and the like, as part of a mobile communication network, the wireless Internet module 113 performs such wireless Internet access. As such, the Internet module 113 may cooperate with, or function as, the mobile communication module 112.

The short-range communication module 114 is configured to facilitate short-range communications. Suitable technologies for implementing such short-range communications include BLUETOOTH™, Radio Frequency IDentification (RFID), Infrared Data Association (IrDA), Ultra-WideBand (UWB), ZigBee, Near Field Communication (NFC), Wireless-Fidelity (Wi-Fi), Wi-Fi Direct, Wireless USB (Wireless Universal Serial Bus), and the like. The short-range communication module 114 in general supports wireless communications between the electronic device 100 and a wireless communication system, communications between the electronic device 100 and another electronic device, or communications between the electronic device and a network where another electronic device (or an external server)

is located, via wireless area networks. One example of the wireless area networks is a wireless personal area networks.

Here, another electronic device may be a wearable device, for example, a smart watch, a smart glass or a head mounted display (HMD), which can exchange data with the electronic device 100 (or otherwise cooperate with the electronic device 100). The short-range communication module 114 can sense or recognize the wearable device, and permit communication between the wearable device and the electronic device 100. In addition, when the sensed wearable device is a device which is authenticated to communicate with the electronic device 100, the controller 180, for example, can cause transmission of at least part of data processed in the electronic device 100 to the wearable device via the short-range communication module 114. Hence, a user of the wearable device can use the data processed in the electronic device 100 on the wearable device. For example, when a call is received in the electronic device 100, the user can answer the call using the wearable device. Also, when a message is received in the electronic device 100, the user can check the received message using the wearable device.

The location information module 115 is generally configured to detect, calculate, derive or otherwise identify a position (or current position) of the electronic device 100. As an example, the location information module 115 includes a Global Position System (GPS) module, a Wi-Fi module, or both. For example, when the electronic device 100 uses a GPS module, a position of the electronic device 100 may be acquired using a signal sent from a GPS satellite. As another example, when the electronic device 100 uses the Wi-Fi module, a position of the electronic device 100 may be acquired based on information related to a wireless access point (AP) which transmits or receives a wireless signal to or from the Wi-Fi module. If desired, the location information module 115 may alternatively or additionally perform a function of any of the other modules of the wireless communication unit 110 to obtain data related to the position of the electronic device 100. The location information module 115 is a module used for acquiring the position (or the current position) of the electronic device 100, and is not limited to a module for directly calculating or acquiring the position of the electronic device 100.

Next, the input unit 120 is configured to permit various types of inputs to the electronic device 100. Examples of such inputs include image information (or signal), audio information (or signal), data or various information input by a user, and may be provided with one or a plurality of cameras 121. Such cameras 121 may process image frames of still pictures or video obtained by image sensors in a video or image capture mode. The processed image frames can be displayed on the display unit 151 or stored in memory 170. In addition, the cameras 121 may be arranged in a matrix configuration to permit a plurality of images having various angles or focal points to be input to the electronic device 100. Also, the cameras 121 may be located in a stereoscopic arrangement to acquire left and right images for implementing a stereoscopic image.

The microphone 122 processes an external audio signal into electric audio (sound) data. The processed audio data may be processed in various manners according to a function being executed in the electronic device 100. If desired, the microphone 122 may include assorted noise removing algorithms to remove unwanted noise generated in the course of receiving the external audio signal.

The user input unit 123 is a component that permits input by a user. Such user input enables the controller 180 to control an operation of the electronic device 100. The user input unit 123 may include one or more of a mechanical input element (for example, a mechanical key, a button located on a front and/or rear surface or a side surface of the electronic device 100, a dome switch, a jog wheel, a jog switch, and the like), or a touch-sensitive input element, among others. As one example, the touch-sensitive input element may be a virtual key, a soft key or a visual key, which is displayed on a touch screen through software processing, or a touch key which is located on the mobile terminal at a location that is other than the touch screen. Further, the virtual key or the visual key may be displayed on the touch screen in various shapes, for example, graphic, text, icon, video, or a combination thereof.

The sensing unit 140 is generally configured to sense one or more of internal information of the electronic device 100, surrounding environment information of the electronic device 100, user information, or the like, and generates a corresponding sensing signal. The controller 180 generally cooperates with the sending unit 140 to control operations of the electronic device 100 or execute data processing, a function or an operation associated with an application program installed in the electronic device 100 based on the sensing signal. The sensing unit 140 may be implemented using any of a variety of sensors, some of which will now be described in more detail.

The proximity sensor 141 refers to a sensor to sense presence or absence of an object approaching a surface, or an object located near a surface, by using an electromagnetic field, infrared rays, or the like without a mechanical contact. The proximity sensor 141 may be arranged at an inner region of the electronic device 100 covered by the touch screen, or near the touch screen.

The proximity sensor 141, for example, may include any of a transmissive type photoelectric sensor, a direct reflective type photoelectric sensor, a mirror reflective type photoelectric sensor, a high-frequency oscillation proximity sensor, a capacitance type proximity sensor, a magnetic type proximity sensor, an infrared rays proximity sensor, and the like. When the touch screen is implemented as a capacitance type, the proximity sensor 141 can sense proximity of a pointer relative to the touch screen by changes of an electromagnetic field, which is responsive to an approach of an object with conductivity. In this instance, the touch screen (touch sensor) may also be categorized as a proximity sensor.

The term "proximity touch" will often be referred to herein to denote the scenario in which a pointer is positioned to be proximate to the touch screen without contacting the touch screen. The term "contact touch" will often be referred to herein to denote the scenario in which a pointer makes physical contact with the touch screen. For the position corresponding to the proximity touch of the pointer relative to the touch screen, such position will correspond to a position where the pointer is perpendicular to the touch screen. The proximity sensor 141 may sense proximity touch, and proximity touch patterns (for example, distance, direction, speed, time, position, moving status, and the like). In general, the controller 180 can process data corresponding to proximity touches and proximity touch patterns sensed by the proximity sensor 141, and cause visual information corresponding to the processed data to be output on the touch screen. In addition, the controller 180 can control the electronic device 100 to execute different operations or process different data (or information) according to whether a touch with respect to the same point on the touch screen is either a proximity touch or a contact touch.

A touch sensor senses a touch (or a touch input) applied to the touch screen (or the display unit 151) using any of a variety of touch methods. Examples of such touch methods include a resistive type, a capacitive type, an infrared type, and a magnetic field type, among others.

As one example, the touch sensor can convert changes of pressure applied to a specific part of the display unit 151, or convert capacitance occurring at a specific part of the touch screen, into electric input signals. The touch sensor may also be configured to sense not only a touched position and a touched area, but also touch pressure and/or touch capacitance. A touch object is generally used to apply a touch input to the touch sensor. Examples of typical touch objects include a finger, a touch pen, a stylus pen, a pointer, or the like.

When a touch input is sensed by a touch sensor, corresponding signals may be transmitted to a touch controller. The touch controller may process the received signals, and then transmit corresponding data to the controller 180. Accordingly, the controller 180 can sense which region of the display unit 151 has been touched. Here, the touch controller may be a component separate from the controller 180, the controller 180, and combinations thereof.

In addition, the controller 180 can execute the same or different controls according to a type of touch object that touches the touch screen or a touch key provided in addition to the touch screen. Whether to execute the same or different control according to the object which provides a touch input may be decided based on a current operating state of the electronic device 100 or a currently executed application program, for example.

The touch sensor and the proximity sensor may be implemented individually, or in combination, to sense various types of touches. Such touches includes a short (or tap) touch, a long touch, a multi-touch, a drag touch, a flick touch, a pinch-in touch, a pinch-out touch, a swipe touch, a hovering touch, and the like.

If desired, an ultrasonic sensor may be implemented to recognize location information relating to a touch object using ultrasonic waves. The controller 180, for example, may calculate a position of a wave generation source based on information sensed by an illumination sensor and a plurality of ultrasonic sensors. Since light is much faster than ultrasonic waves, the time for which the light reaches the optical sensor is much shorter than the time for which the ultrasonic wave reaches the ultrasonic sensor. The position of the wave generation source may be calculated using this fact. For instance, the position of the wave generation source may be calculated using the time difference from the time that the ultrasonic wave reaches the sensor based on the light as a reference signal.

The camera 121, which has been depicted as a component of the input unit 120, typically includes at least one a camera sensor (CCD, CMOS etc.), a photo sensor (or image sensors), and a laser sensor. Implementing the camera 121 with a laser sensor may allow detection of a touch of a physical object with respect to a 3D stereoscopic image. The photo sensor may be laminated on, or overlapped with, the display device. The photo sensor can scan movement of the object in vicinity of the touch screen. In more detail, the photo sensor may include photo diodes and transistors (TRs) at rows and columns to scan content received at the photo sensor using an electrical signal which changes according to the quantity of applied light. Namely, the photo sensor may calculate the coordinates of the physical object according to variation of light to thus obtain location information of the physical object.

The display unit 151 is generally configured to output information processed in the electronic device 100. For example, the display unit 151 can display execution screen information of an application program executing at the electronic device 100 or user interface (UI) and graphic user interface (GUI) information in response to the execution screen information.

Also, the display unit 151 may be implemented as a stereoscopic display unit for displaying stereoscopic images. A typical stereoscopic display unit may employ a stereoscopic display scheme such as a stereoscopic scheme (a glass scheme), an auto-stereoscopic scheme (glassless scheme), a projection scheme (holographic scheme), or the like.

The audio output module 152 can receive audio data from the wireless communication unit 110 or output audio data stored in the memory 170 during modes such as a signal reception mode, a call mode, a record mode, a voice recognition mode, a broadcast reception mode, and the like. The audio output module 152 can provide audible output related to a particular function (e.g., a call signal reception sound, a message reception sound, etc.) performed by the electronic device 100. The audio output module 152 may also be implemented as a receiver, a speaker, a buzzer, or the like.

A haptic module 153 can be configured to generate various tactile effects that a user feels, perceives, or otherwise experiences. A typical example of a tactile effect generated by the haptic module 153 is vibration. The strength, pattern and the like of the vibration generated by the haptic module 153 can be controlled by user selection or setting by the controller. For example, the haptic module 153 can output different vibrations in a combining manner or a sequential manner.

Besides vibration, the haptic module 153 can generate various other tactile effects, including an effect by stimulation such as a pin arrangement vertically moving to contact skin, a spray force or suction force of air through a jet orifice or a suction opening, a touch to the skin, a contact of an electrode, electrostatic force, an effect by reproducing the sense of cold and warmth using an element that can absorb or generate heat, and the like.

The haptic module 153 can also be implemented to allow the user to feel a tactile effect through a muscle sensation such as the user's fingers or arm, as well as transferring the tactile effect through direct contact. Two or more haptic modules 153 may be provided according to the particular configuration of the electronic device 100.

An optical output module 154 can output a signal for indicating an event generation using light of a light source of the electronic device 100. Examples of events generated in the electronic device 100 may include message reception, call signal reception, a missed call, an alarm, a schedule notice, an email reception, information reception through an application, and the like.

A signal output by the optical output module 154 can be implemented so the electronic device 100 emits monochromatic light or light with a plurality of colors to a front or rear surface. The signal output can be terminated as the electronic device 100 senses that a user has checked the generated event, for example.

The interface unit 160 serves as an interface for every external device to be connected with the electronic device 100. For example, the interface unit 160 can receive data transmitted from an external device, receive power to transfer to elements and components within the electronic device 100, or transmit internal data of the electronic device 100 to such external device. The interface unit 160 may include wired or wireless headset ports, external power supply ports, wired or wireless data ports, memory card ports, ports for connecting a device having an identification module, audio input/output (I/O) ports, video I/O ports, earphone ports, or the like.

The identification module may be a chip that stores various information for authenticating authority of using the electronic device 100 and may include a user identity module (UIM), a subscriber identity module (SIM), a universal subscriber identity module (USIM), and the like. In addition, the device having the identification module (also referred to herein as an "identifying device") may take the form of a smart card. Accordingly, the identifying device can be connected with the electronic device 100 via the interface unit 160.

When the electronic device 100 is connected with an external cradle, the interface unit 160 can serve as a passage to allow power from the cradle to be supplied to the electronic device 100 or may serve as a passage to allow various command signals input by the user from the cradle to be transferred to the electronic device 100 therethrough. Various command signals or power input from the cradle may operate as signals for recognizing that the electronic device 100 is properly mounted on the cradle.

The memory 170 can store programs to support operations of the controller 180 and store input/output data (for example, phonebook, messages, still images, videos, etc.). The memory 170 may store data related to various patterns of vibrations and audio which are output in response to touch inputs on the touch screen.

The memory 170 may include one or more types of storage mediums including a flash memory type, a hard disk type, a solid state disk (SSD) type, a silicon disk drive (SDD) type, a multimedia card micro type, a card-type memory (e.g., SD or DX memory, etc.), a Random Access Memory (RAM), a Static Random Access Memory (SRAM), a Read-Only Memory (ROM), an Electrically Erasable Programmable Read-Only Memory (EEPROM), a Programmable Read-Only memory (PROM), a magnetic memory, a magnetic disk, an optical disk, and the like. The electronic device 100 may also be operated in relation to a network storage device that performs the storage function of the memory 170 over a network, such as the Internet.

The controller 180 can typically control operations relating to application programs and the general operations of the electronic device 100. For example, the controller 180 can set or release a lock state for restricting a user from inputting a control command with respect to applications when a status of the electronic device 100 meets a preset condition.

The controller 180 can also perform the controlling and processing associated with voice calls, data communications, video calls, and the like, or perform pattern recognition processing to recognize a handwriting input or a picture drawing input performed on the touch screen as characters or images, respectively. In addition, the controller 180 can control one or a combination of those components in order to implement various exemplary embodiments disclosed herein on the electronic device 100 according to an embodiment of the present invention.

The power supply unit 190 receives external power or provides internal power and supply the appropriate power required for operating respective elements and components included in the mobile terminal 100 under the control of the controller 180. The power supply unit 190 may include a battery, which is typically rechargeable or be detachably coupled to the terminal body for charging.

The power supply unit 190 may include a connection port. The connection port may be configured as one example of the interface unit 160 to which an external charger for supplying power to recharge the battery is electrically connected. As another example, the power supply unit 190 can recharge the battery in a wireless manner without use of the connection port. In this example, the power supply unit 190 can receive power, transferred from an external wireless power transmitter, using at least one of an inductive coupling method which is based on magnetic induction or a magnetic resonance coupling method which is based on electromagnetic resonance. Various embodiments described herein may be implemented in a computer-readable medium, a machine-readable medium, or similar medium using, for example, software, hardware, or any combination thereof.

Figure 1B:
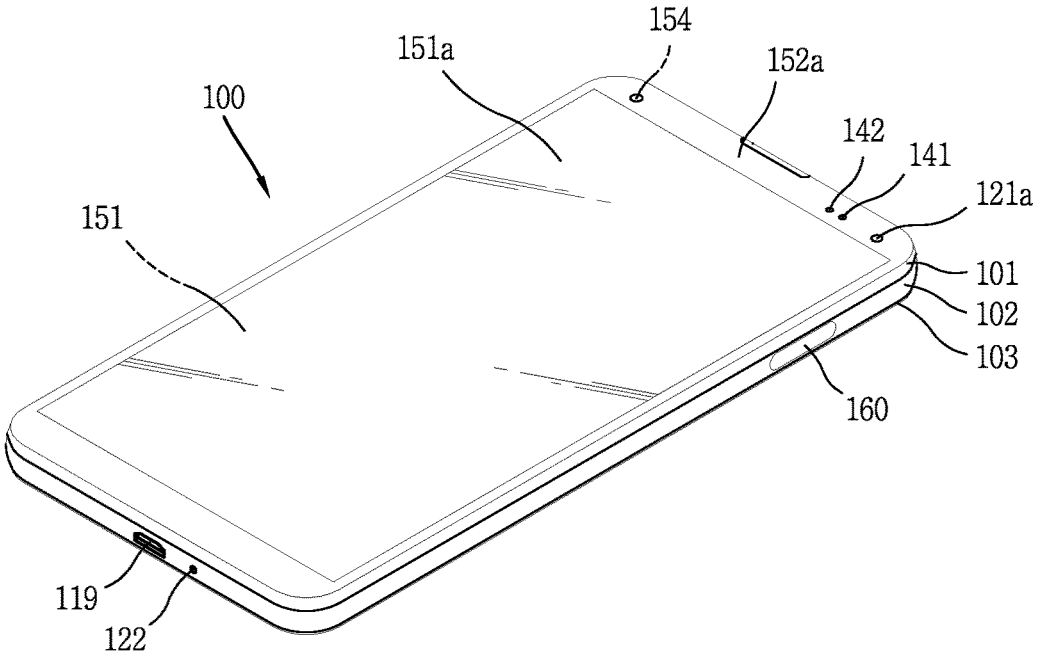
FIGS. 1B and 1C are conceptual views of an electronic device according to an embodiment of the present disclosure, viewed in different directions.
Figure 1C:
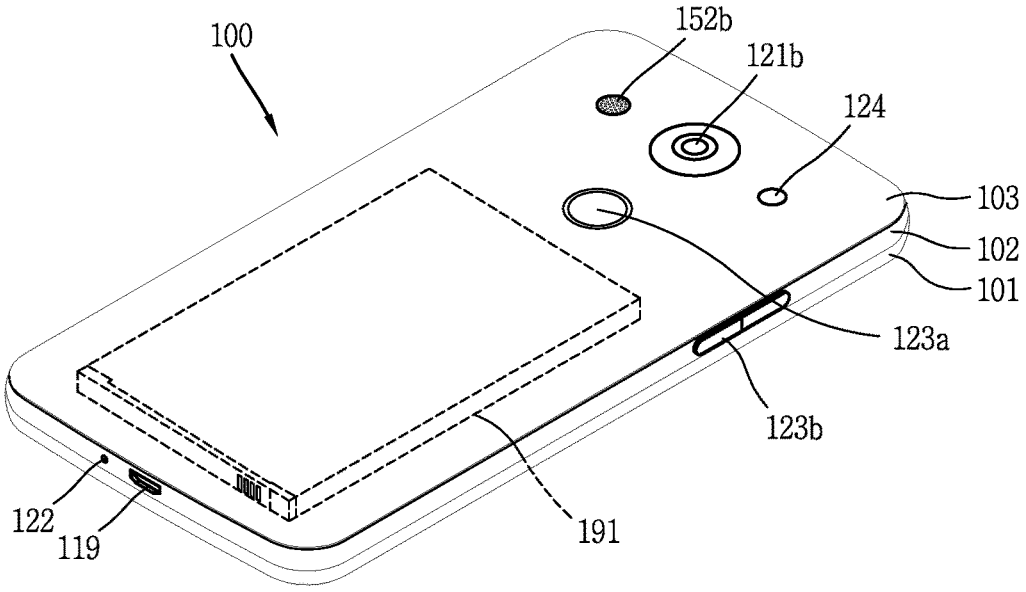

Hereinafter, description will be given of a structure of the electronic device 100 according to the one embodiment of the present invention illustrated in FIG. 1A or a terminal having those components, with reference to FIGS. 1B and 1C. Referring to FIGS. 1B and 1C, the disclosed electronic device 100 includes a bar-like terminal body.

However, the mobile terminal 100 may alternatively be implemented in any of a variety of different configurations. Examples of such configurations include watch type, clip-type, glasses-type, or a folder-type, flip-type, slide-type, swing-type, and swivel-type in which two and more bodies are combined with each other in a relatively movable manner, and combinations thereof. Discussion herein will often relate to a particular type of electronic device. However, such teachings with regard to a particular type of electronic device will generally be applied to other types of electronic devices as well.

The electronic device 100 will generally include a case (for example, frame, housing, cover, and the like) forming the appearance of the terminal. In this embodiment, the electronic device 100 may include a front case 101 and a rear case 102. Various electronic components are interposed into a space formed between the front case 101 and the rear case 102. At least one middle case may be additionally positioned between the front case 101 and the rear case 102.

The display unit 151 is shown located on the front side of the terminal body to output information. As illustrated, a window 151*a* of the display unit 151 may be mounted to the front case 101 to form the front surface of the terminal body together with the front case 101. Electronic components may also be mounted to the rear case 102. Examples of such electronic components include a detachable battery 191, an identification module, a memory card, and the like. In this instance, a rear cover 103 is shown covering the electronic components, and this cover may be detachably coupled to the rear case 102. Therefore, when the rear cover 103 is detached from the rear case 102, the electronic components mounted on the rear case 102 are exposed to the outside.

As illustrated, when the rear cover 103 is coupled to the rear case 102, a side surface of the rear case 102 may partially be exposed. In some instances, upon the coupling, the rear case 102 may also be completely shielded by the rear cover 103. In addition, the rear cover 103 may include an opening for externally exposing a camera 121*b* or an audio output module 152*b*.

The cases 101, 102, 103 can be formed by injection-molding synthetic resin or can be formed of a metal, for example, stainless steel (STS), aluminum (Al), titanium (Ti), or the like. As an alternative to the example in which the plurality of cases form an inner space for accommodating components, the electronic device 100 may be configured such that one case forms the inner space. In this instance, an electronic device 100 having a uni-body is formed so synthetic resin or metal extends from a side surface to a rear surface.

In addition, the electronic device 100 may include a waterproofing unit for preventing introduction of water into the terminal body. For example, the waterproofing unit may include a waterproofing member which is located between the window 151*a* and the front case 101, between the front case 101 and the rear case 102, or between the rear case 102 and the rear cover 103, to hermetically seal an inner space when those cases are coupled.

The electronic device 100 may include a display unit 151, first and second audio output module 152*a* and 152*b*, a proximity sensor 141, an illumination sensor 142, an optical output module 154, first and second cameras 121*a* and 121*b*, first and second manipulation units 123*a* and 123*b*, a microphone 122, an interface unit 160, and the like.

Hereinafter, as illustrated in FIGS. 1B and 1C, description will be given of the exemplary electronic device 100 in which the front surface of the terminal body is shown having the display unit 151, the first audio output module 152*a*, the proximity sensor 141, the illumination sensor 142, the optical output module 154, the first camera 121*a*, and the first manipulation unit 121*a*, the side surface of the terminal body is shown having the second manipulation unit 123*b*, the microphone 122, and the interface unit 160, and the rear surface of the terminal body is shown having the second audio output module 152*b* and the second camera 121*b*.

However, those components are not limited to the arrangement. Some components can be omitted or rearranged or located on different surfaces. For example, the first manipulation unit 123*a* may be located on another surface of the terminal body, and the second audio output module 152*b* may be located on the side surface of the terminal body other than the rear surface of the terminal body.

The display unit 151 is generally configured to output information processed in the electronic device 100. For example, the display unit 151 may display execution screen information of an application program executing at the electronic device 100 or user interface (UI) and graphic user interface (GUI) information in response to the execution screen information.

The display module 151 may include at least one of a liquid crystal display (LCD), a thin film transistor-LCD (TFT LCD), an organic light-emitting diode (OLED), a flexible display, a three-dimensional (3D) display and an e-ink display. The display unit 151 may be implemented using two display devices, according to the configuration type thereof. For instance, a plurality of the display units 151 may be arranged on one side, either spaced apart from each other, or these devices may be integrated, or these devices may be arranged on different surfaces.

The display unit 151 may include a touch sensor that senses a touch with respect to the display unit 151 so as to receive a control command in a touch manner. Accordingly, when a touch is applied to the display unit 151, the touch sensor may sense the touch, and a controller 180 may generate a control command corresponding to the touch. Contents input in the touch manner may be characters, numbers, instructions in various modes, or a menu item that can be designated.

Further, the touch sensor may be configured in a form of a film having a touch pattern and disposed between a window and a display (not illustrated) on a rear surface of the window, or may be a metal wire directly patterned on the rear surface of the window. Alternatively, the touch sensor can be formed integrally with the display. For example, the touch sensor can be disposed on a substrate of the display, or may be provided inside the display.

In this way, the display unit 151 can form a touch screen together with the touch sensor, and in this instance, the touch screen may function as the user input unit (123, see FIG. 1A). In some cases, the touch screen may replace at least some of functions of a first manipulation unit 123*a*. Hereinafter, for the sake of explanation, the display unit (display module) for outputting the image and the touch sensor are collectively referred to as a touch screen 151.

The first audio output module 152*a* may be implemented as a receiver for transmitting a call sound to a user's ear and the second audio output module 152*b* may be implemented as a loud speaker for outputting various alarm sounds or multimedia playback sounds. The window 151*a* of the display unit 151 may include a sound hole for emitting sounds generated from the first audio output module 152*a*. However, the present invention is not limited thereto, and the sounds may be released along an assembly gap between the structural bodies (for example, a gap between the window 151*a* and the front case 101). In this instance, a hole independently formed to output audio sounds may not be seen or may otherwise be hidden in terms of appearance, thereby further simplifying the appearance of the electronic device 100.

The optical output module 154 can output light for indicating an event generation. Examples of such events may include a message reception, a call signal reception, a missed call, an alarm, a schedule alarm, an email reception, information reception through an application, and the like. When a user has checked a generated event, the controller 180 can control the optical output module 154 to stop the light output.

The first camera 121*a* can process image frames such as still or moving images obtained by the image sensor in a capture mode or a video call mode. The processed image frames can then be displayed on the display unit 151 or stored in the memory 170.

The first and second manipulation units 123*a* and 123*b* are examples of the user input unit 123, which can be manipulated by a user to provide input to the electronic device 100. The first and second manipulation units 123*a* and 123*b* may also be commonly referred to as a manipulating portion. The first and second manipulation units 123*a* and 123*b* may employ any method if it is a tactile manner allowing the user to perform manipulation with a tactile feeling such as touch, push, scroll or the like The first and second manipulation units 123*a* and 123*b* may also be manipulated through a proximity touch, a hovering touch, and the like, without a user's tactile feeling.

The drawings are illustrated on the basis that the first manipulation unit 123*a* is a touch key, but the present disclosure is not limited to this. For example, the first manipulation unit 123*a* may be configured with a mechanical key, or a combination of a touch key and a push key.

The content received by the first and second manipulation units 123*a* and 123*b* may be set in various ways. For example, the first manipulation unit 123*a* may be used by the user to input a command such power on/off, start, end, switching to a touch recognition mode of the display unit 151 or the like, and the second manipulation unit 123*b* may be used by the user to input a command, such as controlling a volume level being output from the first or second audio output module 152*a* or 152*b*, switching into a touch recognition mode of the display unit 151, or the like.

The first manipulation unit 123*a* can be disposed to overlap the display unit 151 of the front surface in a thickness direction of the terminal body. As one example, the rear input unit can be disposed on an upper end portion of the rear surface of the terminal body such that a user can easily manipulate it using a forefinger when the user grabs the terminal body with one hand. However, the present invention may not be limited to this, and the position of the first manipulation unit 123*a* may be changeable.

When the first manipulation unit 123*a* is disposed on the rear surface of the terminal body, a new user interface may be implemented using the first manipulation unit 123*a*. In addition, the display unit 151 may be configured as a larger screen.

Further, the electronic device 100 may include a finger scan sensor which scans a user's fingerprint. The controller 180 can use fingerprint information sensed by the finger scan sensor as an authentication means. The finger scan sensor may be installed in the display unit 151 or the user input unit 123.

The microphone 122 can receive the user's voice, other sounds, and the like. The microphone 122 may be provided at a plurality of places, and configured to receive stereo sounds.

The interface unit 160 serves as a path allowing the electronic device 100 to interface with external devices. For example, the interface unit 160 may be at least one of a connection terminal for connecting to another device (for example, an earphone, an external speaker, or the like), a port for near field communication (for example, an Infrared Data Association (IrDA) port, a Bluetooth port, a wireless LAN port, and the like), or a power supply terminal for supplying power to the electronic device 100. The interface unit 160 may be implemented in the form of a socket for accommodating an external card, such as Subscriber Identification Module (SIM), User Identity Module (UIM), or a memory card for information storage.

The second camera 121*b* may be further mounted to the rear surface of the terminal body. The second camera 121*b* may have an image capturing direction, which is substantially opposite to the direction of the first camera unit 121*a*. The second camera 121*b* may include a plurality of lenses arranged along at least one line. The plurality of lenses may be arranged in a matrix form. The cameras may be referred to as an 'array camera.'

When the second camera 121*b* is implemented as the array camera, images may be captured in various manners using the plurality of lenses and images with better qualities may be obtained. The flash 124 can be disposed adjacent to the second camera 121*b*. When an image of a subject is captured with the camera 121*b*, the flash 124 may illuminate the subject.

The second audio output module 152*b* may further be disposed on the terminal body. The second audio output module 152*b* may implement stereophonic sound functions in conjunction with the first audio output module 152*a*, and may be also used for implementing a speaker phone mode for call communication.

At least one antenna for wireless communication can be disposed on the terminal body. The antenna may be embedded in the terminal body or formed in the case. For example, an antenna which configures a part of the broadcast receiving module 111 (see FIG. 1A) may be retractable into the terminal body. Alternatively, an antenna can be formed in a form of film to be attached onto an inner surface of the rear cover 103 or a case including a conductive material may serve as an antenna.

The terminal body is provided with a power supply unit 190 (see FIG. 1A) for supplying power to the electronic device 100. The power supply unit 190 may include a batter 191 which is mounted in the terminal body or detachably coupled to an outside of the terminal body.

The battery 191 may receive power via a power cable connected to the interface unit 160. Also, the battery 191 may be (re)chargeable in a wireless manner using a wireless charger. The wireless charging may be implemented by magnetic induction or electromagnetic resonance.

Further, the drawing illustrates that the rear cover 103 is coupled to the rear case 102 for shielding the battery 191, so as to prevent separation of the battery 191 and protect the battery 191 from an external impact or foreign materials. When the battery 191 is detachable from the terminal body, the rear case 103 may be detachably coupled to the rear case 102.

An accessory for protecting an appearance or assisting or extending the functions of the electronic device 100 may further be provided on the electronic device 100. As one example of the accessory, a cover or pouch for covering or accommodating at least one surface of the electronic device 100 may be provided. The cover or pouch may cooperate with the display unit 151 to extend the function of the electronic device 100. Another example of the accessory may be a touch pen for assisting or extending a touch input onto a touch screen.

The present disclosure relates to an electronic device 100 in which an antenna is provided in a display unit 151. The antenna may be implemented in the form of an array antenna. The antenna may be implemented as an antenna for a 4G ($4^{th}$-generation) communication service or may also be implemented as an antenna for a 5G ($5^{th}$-generation) communication service.

In this regard, 4G mobile communication mainly uses frequencies below 2 GHz, whereas 5G mobile communication uses an (ultra) high band frequency of about 28 GHz or 39 GHz, unlike 4G Long Term Evolution (LTE). A low-band frequency has a wide coverage due to a long wavelength, but communication using the low-band frequency is slow in transmission speed due to a relatively narrow bandwidth.

Further, a high band frequency has a narrow coverage due to a short wavelength, but communication using the high band frequency is fast in transmission speed due to a relatively wide bandwidth. In addition, communication using the high-band frequency can solve a coverage restriction to some extent by using propagation characteristics with high linearity (or straightness), an array antenna, and the like. Therefore, the 5G mobile communication can increase insufficient capacity, provide a variety of communication services to the users, and provide a mobile Internet technology and an M2M (Machine to Machine) technology.

The use of a printed antenna implemented on a related art circuit board or a chip antenna disposed on a circuit board for the purpose of radiation of the antenna for 5G mobile communication may degrade performance of the antenna for 5G mobile communication. In particular, the printed antenna or the chip antenna has a very high loss in the 5G frequency band (for example, 28 GHz or 39 GHz band).

Further, electromagnetic waves of the antenna are radiated to a front surface or a rear surface of the electronic device 100. However, when the rear surface of the electronic device 100 is covered with the palm of the hand, it is difficult for electromagnetic waves to be radiated through the rear surface. Further, radiation to the front surface of the electronic device 100 is difficult to pass through the display.

In order to solve such problems, the antenna for 5G mobile communication can be configured as an array antenna using a transparent electrode within the display unit 151. First, a principle for uniformly maintaining horizontal/vertical polarization (or polarization on arbitrary two axes which are perpendicular to each other) characteristics, while reducing loss due to dual-feeding of an array antenna, compared with the existing technology, will be described.

Figure 2A:
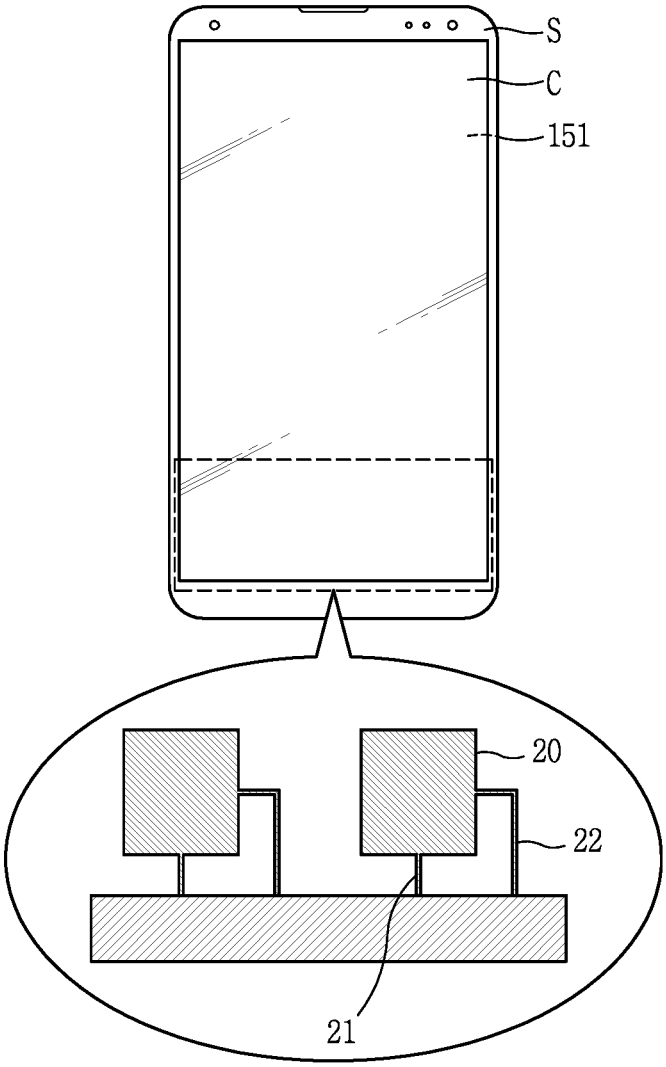
FIG. 2A is a conceptual view illustrating a configuration of a general dual-polarized patch antenna in an electronic device related to the present disclosure.

In this regard, FIG. 2A illustrates a configuration of a general vertical/horizontal dual polarized patch antenna 20 in the electronic device related to the present invention. In addition, FIG. 2B illustrates an example of a dual polarized patch antenna 200 included in the display unit 151 according to an embodiment of the present invention, and FIG. 2C illustrates another example of an antenna 200' provided in the display unit 151.

Figure 2B:
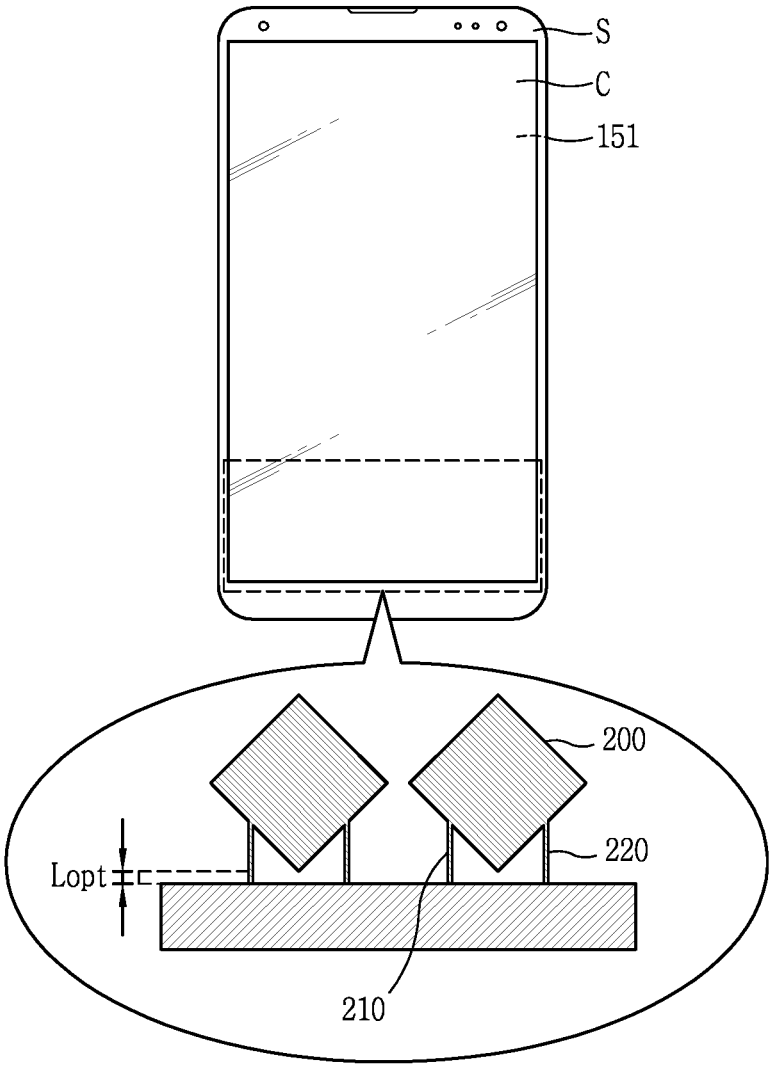
FIG. 2B is a conceptual view illustrating an example of a dual-polarized patch antenna provided in a display unit according to the present disclosure.
Figure 2C:
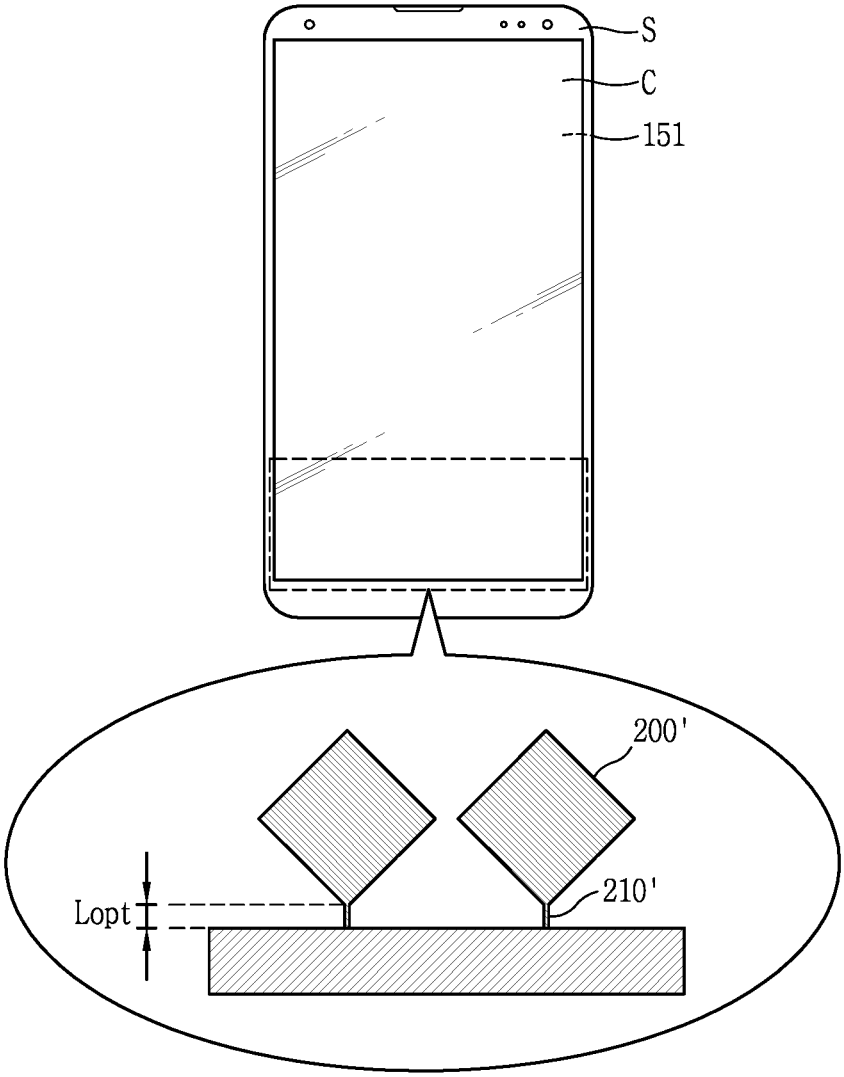
FIG. 2C is a conceptual view illustrating another example of an antenna provided in a display unit according to the present disclosure.

Referring to FIGS. 2A to 2C, the display unit 151 is divided into an output region C for outputting visual information and an opaque bezel region S surrounding the output region C. A display outputting visual information is disposed in the output region C. Further, the patch antenna 200 is disposed within the display and overlaps the output region C. The patch antenna 200 is arranged on a position spaced apart from one side of the output region (or one side of the display) by a preset interval.

Referring to FIG. 2A, a general patch antenna 20 is disposed such that one side thereof is in parallel with one side of the output region C. The patch antenna 20 is also connected to a first feeding line 21 providing a signal for the patch antenna 20 to operate in a first polarization form and a second feeding line 22 providing a signal for the patch antenna 20 to operate in a second polarization form perpendicular to the first polarization form. Here, compared with the first feeding line 21, the second feeding line 22 is long in electrical length, increasing radiation loss due to bending (e.g., 90° bending), as well as feeding loss.

However, referring to FIG. 2B, the patch antenna 200 is disposed to be sloped at a predetermined angle with respect to the boundary between the output region C and the bezel region S. For example, two sides of the patch antenna 200 perpendicular to each other may be sloped at angles of +45 degrees and −45 degrees with respect to the boundary between the output region C and the bezel region 5, respectively.

Further, the first feeding line 210 is connected to a midpoint of a first line segment of the patch antenna 200 and the second feeding line 220 is connected to a midpoint of a second line segment perpendicular to the first line segment, implementing dual-feeding. As illustrated, the first and second feeding lines 210 and 220 are parallel to each other and have a same length.

According to this structure, when the patch antenna 200 operates as a transmitting antenna, a gain can be increased through dual-feeding. In addition, when the patch antenna 200 operates as a receiving antenna, a diversity effect can be obtained through dual-feeding.

The first and second feeding lines 210 and 220 are formed linearly without being bent on a layer in which the patch antenna 200 is disposed. Further, the first and second feeding lines 210 and 220 are disposed to be perpendicular to one side of the output region C. In addition, a space between the patch antennas 200 can be determined such that the first and second feeding lines 210 and 220 are linearly formed.

According to this structure, compared with the first and second feeding lines 21 and 22 of FIG. 2A, the first and second feeding lines 210 and 220 of FIG. 2B are short in electrical length, reducing feeding loss, and since the first and second feeding lines 210 and 220 are formed without being bent, radiation loss is reduced. Also, since the first and second feeding lines 220 are implemented without being bent, isolation characteristics between ports are improved, which is advantageous for radiation. In addition, due to the dual polarization, a HIV polarization pattern works ideally to maximize directivity.

Referring to FIG. 2C, a patch antenna 200' is disposed to be sloped at a predetermined angle with respect to one side of the output region C. A feeding line 210' is in the form of single feeding connected to the patch antenna 200' through a vertex at which two orthogonal sides of the patch antenna 200 meet. This structure is advantageous in that the feeding line 210' for single-feeding is shorter than the length of the first feeding line 21 of FIG. 2A, reducing feeding loss. Also, since the feeding line 210' is not bent, radiation loss is reduced.

Figure 3:
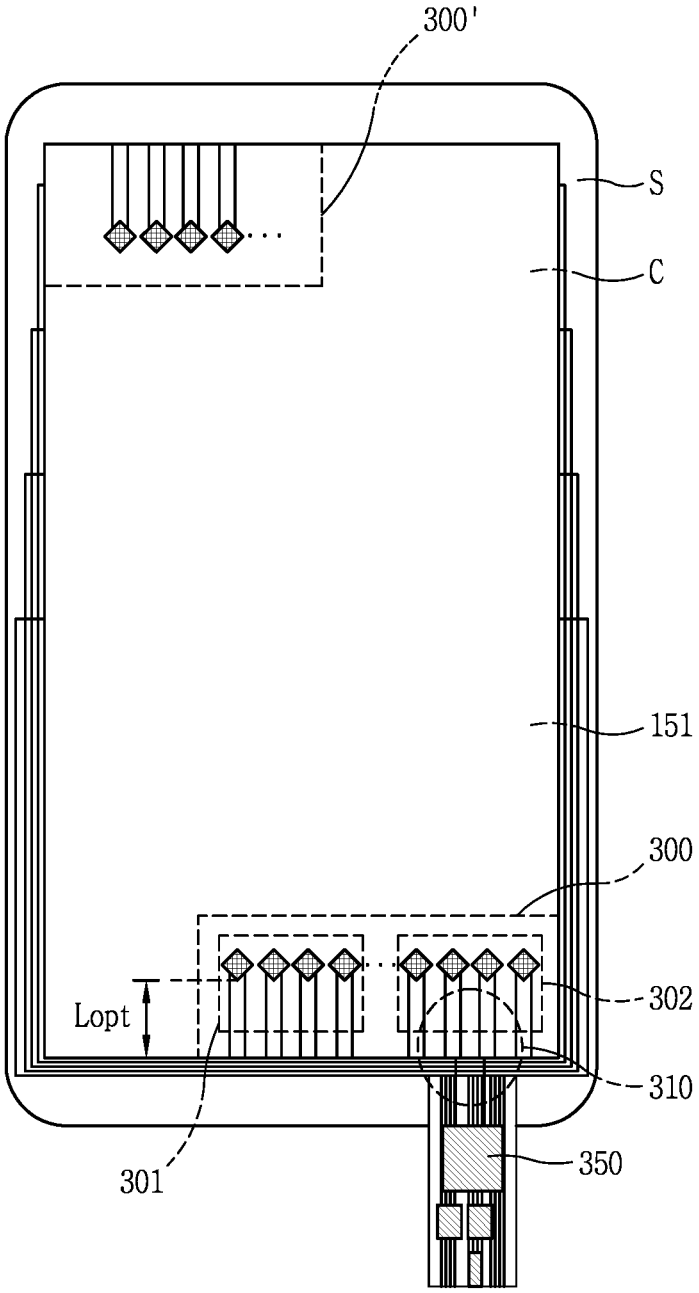
FIG. 3 is a conceptual view illustrating an array antenna provided in a display unit according to the present disclosure.

FIG. 3 is a conceptual view illustrating an array antenna 300 provided in the display unit 151 according to the present disclosure. Antenna elements constituting the array antenna 300 described hereinafter may have the structures of the antennas 200 and 200' described above with reference to FIGS. 2B and 2C.

Referring to FIG. 3, the electronic device 100 includes the array antenna 300, a feeding line 310, the display unit 151, and a radio frequency integrated circuit (RFIC) 350. The array antenna 300 is disposed on any one of a plurality of layers constituting the display unit 151. Each of the antenna elements constituting the array antenna 300 can be arranged in one direction in a position spaced apart from one side of the output region C by a predetermined interval. In FIG. 3, the array antenna 300 is arranged along a lower side at the right lower end of the output region C.

The array antenna 300 or 300' may be provided in plurality. In FIG. 3, the array antenna 300' is additionally arranged at the left upper end of the output region C. The feeding line 310 supplies a signal to each of the antenna elements constituting the array antenna 300 and can be provided in plurality.

As discussed above, the display unit 151 includes a plurality of layers and includes an output region C for displaying visual information and a bezel region S formed to surround the output region C. The output region C corresponds to a portion having light transmitting properties in a window forming an appearance of the display unit 151, and the bezel region S corresponds to a portion having opaque properties in the window.

A distance over which the antenna elements are spaced apart from one side of the output region C can be determined as a distance (optimal distance or optimal length Lopt) in which performance of the array antenna 300 is maximized in consideration of an influence of interference between the bezel region S and the array antenna 300 and feeding loss of the feeding line 310.

In order to minimize feeding loss, the distance can advantageously be a shortest distance which is implementable. In addition, in order to minimize an influence of interference between the bezel region S and the array antenna 300, the distance may be a minimum distance or longer, greater than the shortest distance.

Therefore, the optimal distance Lopt can be determined such that the sum of the feeding loss and the loss due to interference is minimized. For example, the optimal distance Lopt should be equal to or greater than the implementable shortest distance. Alternatively, when the feeding loss is dominant relative to the loss due to interference, it is advantageous that the optimal distance Lopt is equal to or greater than the shortest distance and equal to or less than a minimum distance. Alternatively, when the influence of the loss due to interference is dominant relative to the feeding loss, it is advantageous that the optimal distance Lopt is equal to or greater than the minimum distance.

In addition, the RFIC 350 is electrically connected to the array antenna 300 within the electronic device 100. The RFIC 350 can be disposed on a flexible printed circuit board connecting the display unit 151 and the circuit board. Further, the RFIC 350 may include a high power amplifier (HPA) and a low noise amplifier (LNA). Here, a transmission signal through the HPA is radiated through the array antenna 300, and a reception signal received through the array antenna 300 is amplified through the LNA.

Here, each of the antenna elements constituting the array antenna 300 can be electrically connected to a single port of the RFIC 350 through the feeding line 310. That is, the plurality of feeding lines 310 can be electrically connected to the single port of the RFIC 350. Further, a transmission signal from the HPA can be applied to the array antenna 300 through a duplexer. In addition, the reception signal received through the array antenna 300 can be transmitted to the LNA through the duplexer.

Alternatively, the RFIC 350 may include a plurality of ports corresponding to the plurality of feeding lines 310. Accordingly, the plurality of ports of the RFIC 350 and the plurality of feeding lines 310 can be respectively connected. For example, when four antenna elements are arranged, eight feeding lines 310 can be connected to eight ports of the RFIC 350, respectively.

In addition, as illustrated in FIG. 3, the array antenna 300 may include n sub-array antennas. For example, the array antenna 300 may include a first sub-array antenna 301 and a second sub-array antenna 302. The first and second sub-array antennas 301 may include the same number of or different numbers of antenna elements. For example, the first and second sub-array antennas 301 and 302 may each include m antenna elements (four antenna elements in this figure).

In addition, the array antenna 300 can transmit or receive different information through the first and second sub-array antennas 301 and 302 for a multiple input multiple output (MIMO) operation. Also, for the MIMO operation, some of the sub-array antennas can transmit or receive the same information. When the same information is transmitted or received can be referred to as an operation in a diversity mode, compared with when different information is transmitted or received.

Regarding the MIMO mode, since MIMO is implemented using the first and second sub-array antennas 301 and 302, the first and second sub-array antennas 301 and 302 can be referred to as operating in an n TX mode (2 TX mode in this drawing). Here, n indicates the number of sub-array antennas.

In addition, the array antenna 300 can transmit or receive different information through the respective antenna elements for MIMO operation. Here, since MIMO is implemented using each antenna element, each antenna element can be referred to as operating in (m×n) TX mode (e.g., 4×2=8 TX mode). Here, m denotes the number of antenna elements in the sub-array antenna, and n denotes the number of sub-array antennas.

In addition, when a plurality of array antennas 300 and 300' are provided and spaced apart from each other, beamforming can be realized by changing a phase of a signal applied to each of the antenna elements. FIG. 3 illustrates the array antennas 300 and 300' arranged at the right lower end and the left upper end of the output region C, respectively. Here, a plurality of RFICs 350 can be provided to correspond to the respective array antennas 300 and 300'. For reference, in this drawing, an RFIC connected to the array antenna 300' is omitted.

A phase shifter is disposed within the plurality of RFICs 350 and is configured to change a phase of a signal applied to the antenna elements constituting the array antennas 300 and 300' to realize beamforming in a specific direction. In the MIMO mode, the antenna elements are required to operate such that pieces of different information are transmitted or received without interfering with each other. Thus, beamforming directions of the array antennas 300 and 300' can be different.

For example, the beamforming directions of the array antennas 300 and 300' may be implemented to be θ1 and θ2, respectively. Here, in the beamforming direction θ1 of any one array antenna 300, a radiation pattern level of the other array antenna 300' may be below a specific level. Similarly, in the beamforming direction θ2 of the other array antenna 300', a radiation pattern level of any one array antenna 300 may be below a specific level.

Here, the specific level can be dynamically adjusted to 20 dBc or 30 dBc, or depending on a propagation environment. Alternatively, the phase shifter can control a phase such that a null of a radiation pattern of another array antenna 300' is formed in the beamforming direction θ1 or a null of a radiation pattern of any one antenna array 300 is formed in the beamforming direction θ2.

Figure 4A:
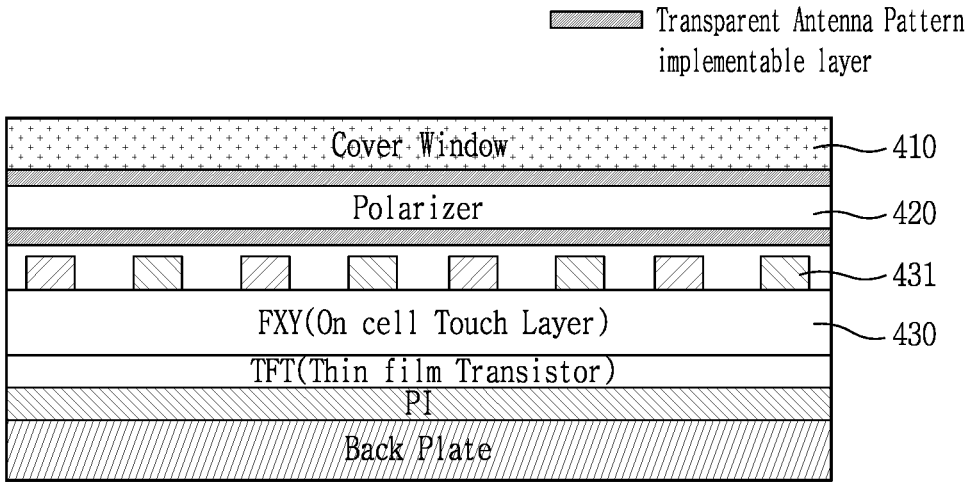
FIG. 4A is a view illustrating a concept implemented by an array antenna in a display unit according to the present disclosure.
Figure 4B:
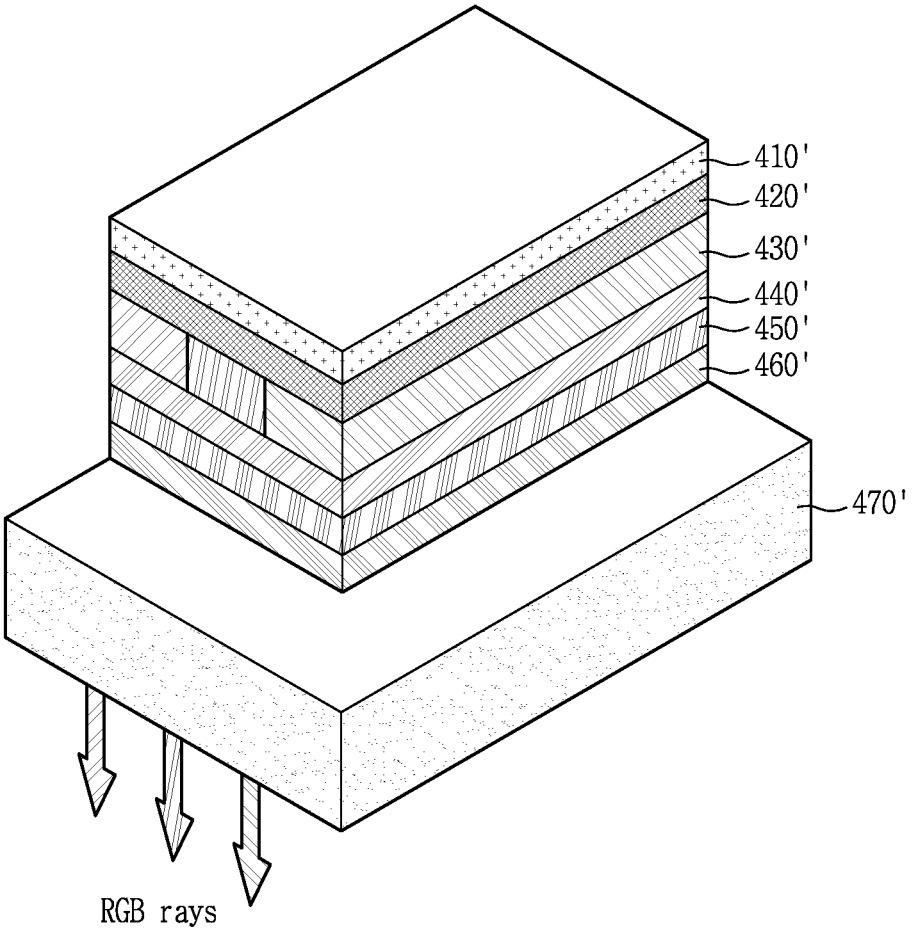
FIG. 4B is a view illustrating a concept implemented by an array antenna in an OLED structure including a plurality of layers.
Figure 4C:
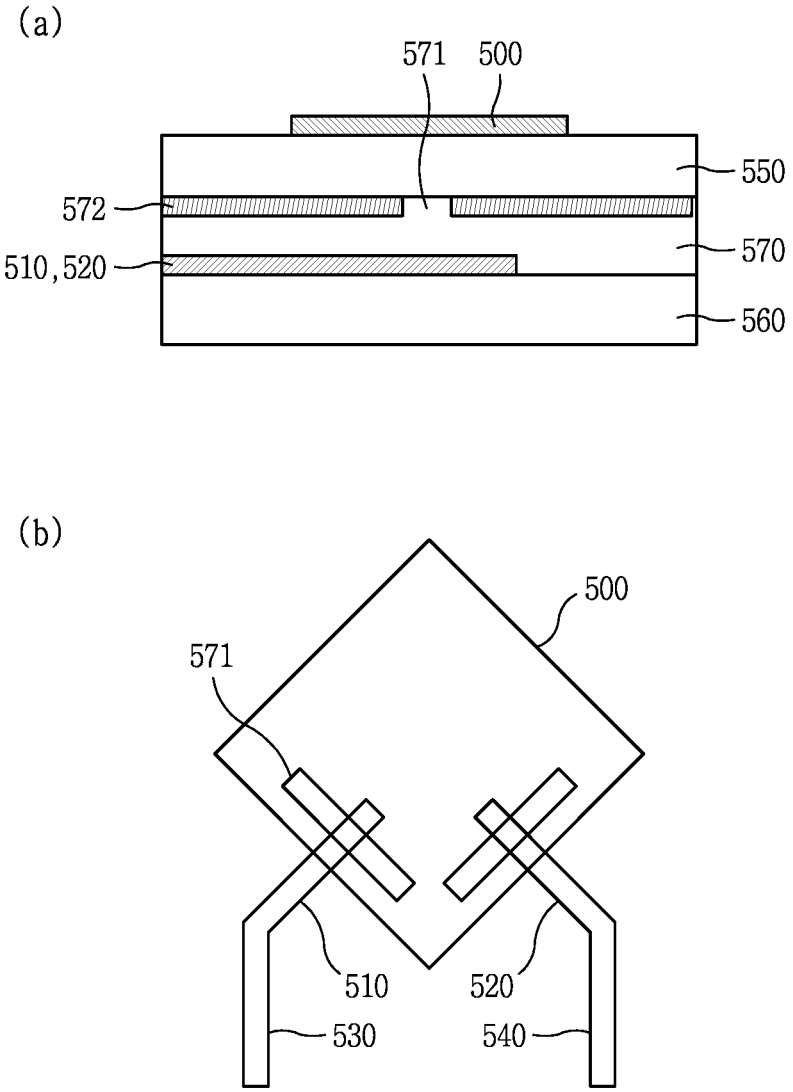
FIG. 4C is a view illustrating an array antenna implemented in a display according to a modification of the present disclosure.

Next, FIG. 4A is a view illustrating a concept of implementing an array antenna according to an embodiment of the present invention in a display unit, and FIG. 4B is a view illustrating a concept of implementing an array antenna in an OLED structure including a plurality of layers. In addition, FIG. 4C is a view illustrating an array antenna implemented in a display according to a modification of the present disclosure.

The antenna element (or patch antenna 200 or 200') described above can be disposed between a cover window 410 and a polarizer 420 or between the polarizer 420 and a touch electrode layer 430, forming a display. For reference, reference numeral 431 denotes a touch electrode. The antenna element may be implemented as a nanosilver or nanowire.

In addition, the nanosilver or nanowire (copper, aluminum, etc.) can be implemented by forming a thin electrode on a transparent film (e.g., an ITO film) in a lattice or mesh form. A silver (Ag) material can be implemented with a line width of 3 μm and spacing of 100 μm or 300 μm, a copper (Cu) material can be implemented with a line width of 90 μm and spacing of 300 μm, 900 μm, 1800 μm, or 2500 μm, and an aluminum (Al) material can be implemented with a line width of 50 μm and spacing of 1000 μm, 1500 μm, or 2000 μm.

When the antenna element is formed of an Ag material, it is not only superior in transparency but also advantageous in electrical characteristics such as radiation characteristics of the antenna. In addition, the silver (Ag) material can be implemented with a narrowest line width and spacing of the lattice (or mesh) may also be finest. Therefore, in a millimeter wave band of the 28 GHz or 39 GHz frequency band, the silver material has an advantage in that the antenna element and a feeding line with a narrow line width may be designed.

In addition, the above-described antenna element and the feeding line can be implemented in the form of a metal mesh. Here, the antenna element and the feeding line are realized in such a form that a metal mesh is electrically connected, and a dielectric region in which the antenna element and the feeding line are not present can be implemented without in a metal mesh.

Alternatively, the metal mesh can be disposed to be adjacent to the antenna element and the feeding line also in the dielectric region as long as the metal mesh does not electrically affect the antenna element and the feeding line. Although not a component to which a signal is transmitted or through which a signal is radiated, the metal mesh disposed in the dielectric region can be evenly disposed in the entire region of the display to enhance visibility of the display.

In addition, referring to FIGS. 2B and 4A, the antenna element 200 and the first and second feeding lines 210 and 220 can be disposed on the same layer. Alternatively, referring to FIGS. 2C and 4A, the antenna element 200' and the feeding line 210' can be disposed on different layers. For example, the antenna element 200' can be disposed between the cover window 410 and the polarizer 420, and the feeding line 310 can be disposed between the polarizer 420 and the touch electrode layer 430.

Referring to FIG. 4B, a display having an OLED (or POLED) structure may include a metal cathode 410', an electrode transport layer 420', an emission layer 430', a hole transport layer 440', a hole injection layer 450', a transparent cathode 460', and a transparent substrate 470'. The metal cathode 410' to the transparent cathode 460' can be formed of a thin film layer having a thickness of tens to hundreds of nanometers.

Unlike an LCD, the display having the OLED (or POLED) structure are realized without a backlight, being thinner than the LCD and self-luminous. In addition, an antenna implemented in the LCD may be degraded in performance when implemented due to a conductive backlight. However, when a patch antenna is implemented on a transparent substrate 470' having non-conductive characteristics of the OLED, an optimal antenna solution may be secured.

In addition, referring to FIG. 4C, an antenna element 500 can be implemented in a slot-coupled form. The antenna element 500 can be disposed on a first layer 550 and first and second feeding lines 510 and 520 can be disposed on a second layer 560 disposed below the first layer 550. A third layer 570 disposed between the first and second layers 550 and 560 may have a slot 571 in which a ground pattern 572 was removed on a ground plane.

Electrical signals from the first and second feeding lines 510 and 520 can be slot-coupled to the antenna element 500 through the slot 571. The dual-feeding antenna having the slot-coupled structure of FIG. 4C is advantageous in that radiation loss of the feeding line is reduced using the separated layer and the ground plane although a length of the feeding line is somewhat increased as compared with the direct-coupled dual-feeding antenna of FIG. 2B.

In addition, the first feeding line 510 is perpendicularly connected to the first side of the antenna element 500 and the second feeding line 520 is connected perpendicularly to the second side of the antenna element 500, having a dual-feeding form. Here, the second side is perpendicular to the first side. As the first and second feeding lines 510 and 520 are disposed to be perpendicular to the two sides of the antenna element 500, polarization purity may be improved.

A third feeding line 530 is slopingly connected to the first feeding line 510. Therefore, a connecting portion between the first feeding line 510 and the third feeding line 530 has a bent shape. Similarly, a fourth feeding line 540 is slopingly connected to the second feeding line 520. Therefore, a connecting portion between the second feeding line 520 and the fourth feeding line 540 has a bent shape.

The third and fourth feeding lines 530 and 540 are electrically connected to an RFIC. The third and fourth feeding lines 530 and 540 can be connected to a single port of the RFIC, or the RFIC may have a plurality of ports respectively connected to the third and fourth feeding lines 530 and 540. The third and fourth feeding lines 530 and 540 can be formed to be parallel to each other and have the same length to facilitate electrical connection with the RFIC.

An additional ground plane can be formed under the second layer 560 on which the first to fourth feeding lines 510, 520, 530, and 540 are disposed. The first to fourth feeding lines 510, 520, 530, and 540 can be formed in a strip line shape by the two ground planes. In this instance, undesirable radiation loss due to the feeding line may be reduced.

In addition, FIG. 4C illustrates the third and fourth feeding lines 530 and 540 are positioned outside the antenna element 500, but the present disclosure is not limited thereto. For example, when a space between the ports of the RFIC connected to the third and fourth feeding lines 530 and 540 is narrow, a part of the third and fourth feeding lines 530 and 540 can be disposed inside the antenna element 500. In this instance, a space between the third and fourth feeding lines 530 and 540 is reduced, and accordingly, feeding loss is reduced according to a reduction in length.

Figure 5:
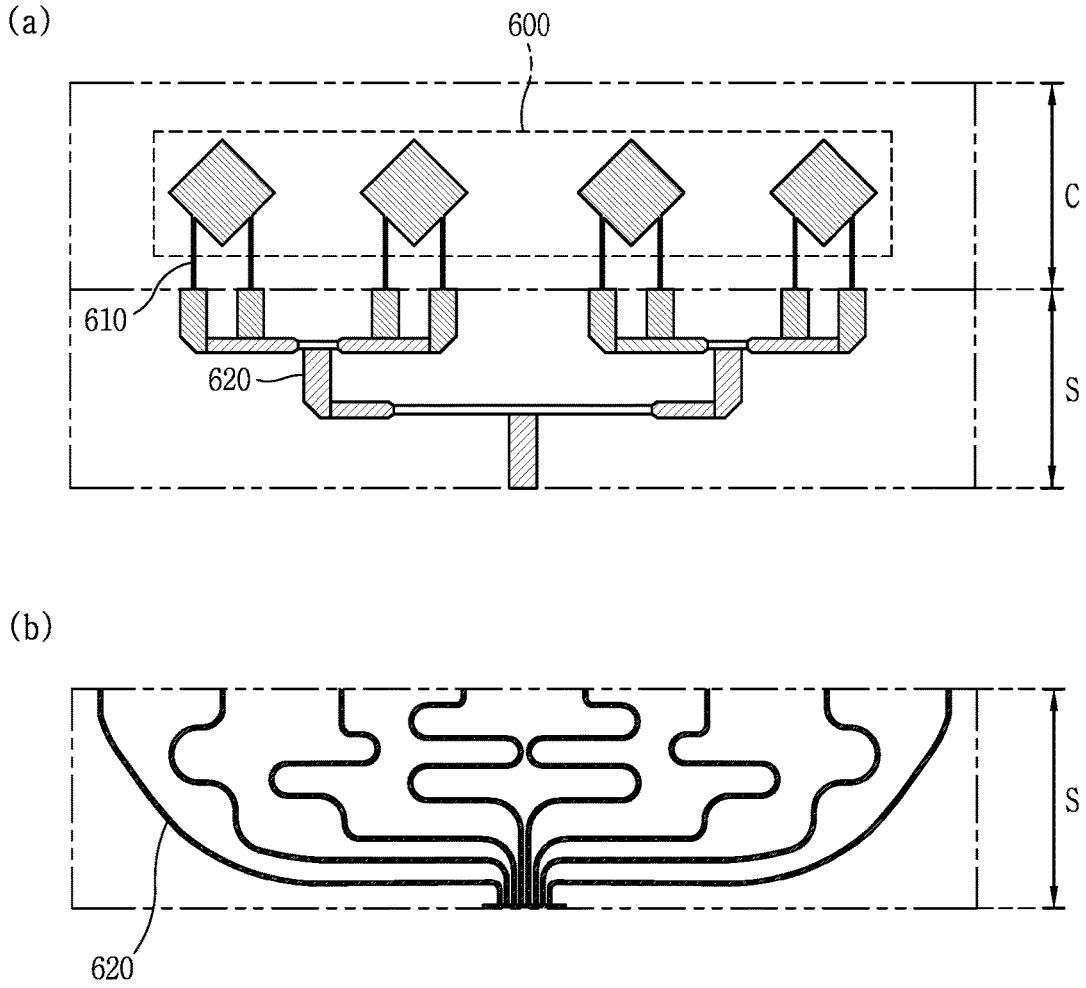
FIG. 5 is a view illustrating a configuration in which an array antenna according to the present disclosure is disposed in an output region and a bezel region.

FIG. 5 is a view illustrating a configuration in which the array antenna according to an embodiment of the present invention is disposed in the output region C and the bezel region S. As illustrated in (a) of FIG. 5, each of the plurality of antenna elements 600 is connected to a first feeding part 610, the first feeding part 610 is connected to a second feeding part 620, and the second feeding part 620 is connected to the RFIC. Here, the first feeding part 610 is disposed in the output region C together with the plurality of antenna elements 600, and the second feeding part 620 is disposed in the bezel region S.

The second feeding part 620 can be configured as at least one power divider that connects the first feeding parts 610 adjacent to each other. FIG. 5 illustrates the second feeding part 620 is configured as a two-stage 2:1 power divider and connected to four antenna elements 600.

The first feeding part 610 is formed of a transparent electrode like the antenna element 600 and is designed to have a short length to maximize radiation characteristics of the antenna element 600. That is, since most feeding lines are implemented using the second feeding part 620, unwanted emission due to the feeding lines can be reduced.

In addition, feeding loss of the power divider increases as a length of the second feeding part 620 increases. In this regard, since the power divided is required to be provided at multiple stages as the number of the antenna elements 600 increases, the length of the second feeding part 620 increases. For example, a 2:1 power divider is used at two stages when four antenna elements 600 are used, while a 2:1 power divider is used at three stages when eight antenna elements 600 are used, increasing the length of the second feeding part 620.

In order to solve the problem, as illustrated in (b) of FIG. 5, the second feeding parts 620 can connect the antenna elements 600 and the RFICs, respectively, regardless of the number of antenna elements 600. Here, the second feeding parts 620 can be bent to have the same length. As illustrated, as the antenna element 600 is closer to the RFIC, the second feeding parts 620 can be bent more.

Figure 6A:
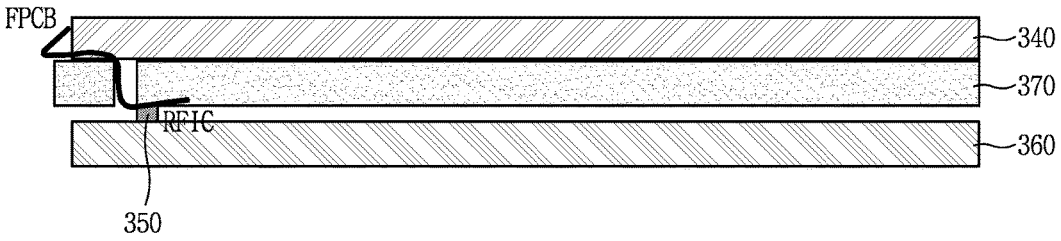
FIGS. 6A and 6B are conceptual views illustrating a structure in which an RFIC is electrically connected to an array antenna provided in a display.
Figure 6B:
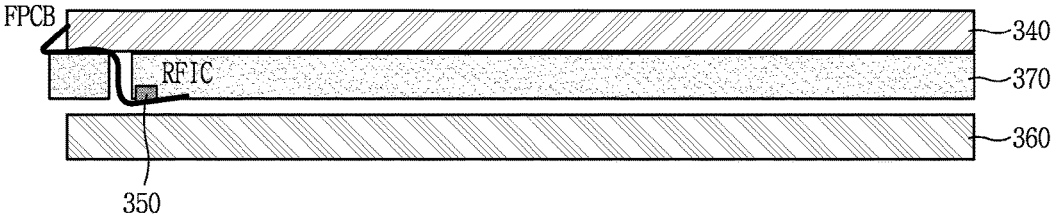

Next, FIGS. 6A and 6B illustrate a structure in which the RFIC 350 is electrically connected to an array antenna provided in the display 340. As illustrated in FIG. 6A, the RFIC 350 can be disposed on a printed circuit board (PCB) 360 below the display 340. Alternatively, as illustrated in FIG. 6B, the RFIC 350 can be seated within a frame 370 disposed between the PCB 360 and the display 340.

As described above, since the array antenna and the RFIC are arranged on different layers, a length of a feeding line is increased. The feeding line can be implemented by an FPCB. Here, electrical connection between the feeding line and the RFIC may advantageously be connectorless connection (i.e., connection without a connector).

In addition, although the two elements are electrically connected, it is not easy to secure performance in a millimeter wave band due to a physical separation structure. For example, when the RFIC is mounted on the PCB and the array antenna is formed in the display, the RFIC and the array antenna should be electrically connected by a separate connection such as an FPCB. In addition, with electrical connection by a feeding line within the FPCB, it is required to minimize feeding loss due to the feeding line.

In order to improve this, the slot coupling structure illustrated in FIG. 4C can be used. For example, the first and second feeding lines 510 and 520 and the RFIC can be formed on the second layer 560, i.e., on the same layer, and an electromagnetic signal can be transmitted to the antenna 500 formed on the first layer through the slot 571 formed on the third layer 570 above the second layer 560. Here, the second layer 560 on which the first and second feeding lines 510 and 520 are disposed can be implemented in the frame 370 or a separate PCB, rather than in the display 340.

In the above, the electronic device having an array antenna implemented in the display has been described. Hereinafter, radiation pattern performance according to positions where the array antenna is disposed on the display will be described.

Figure 7A:
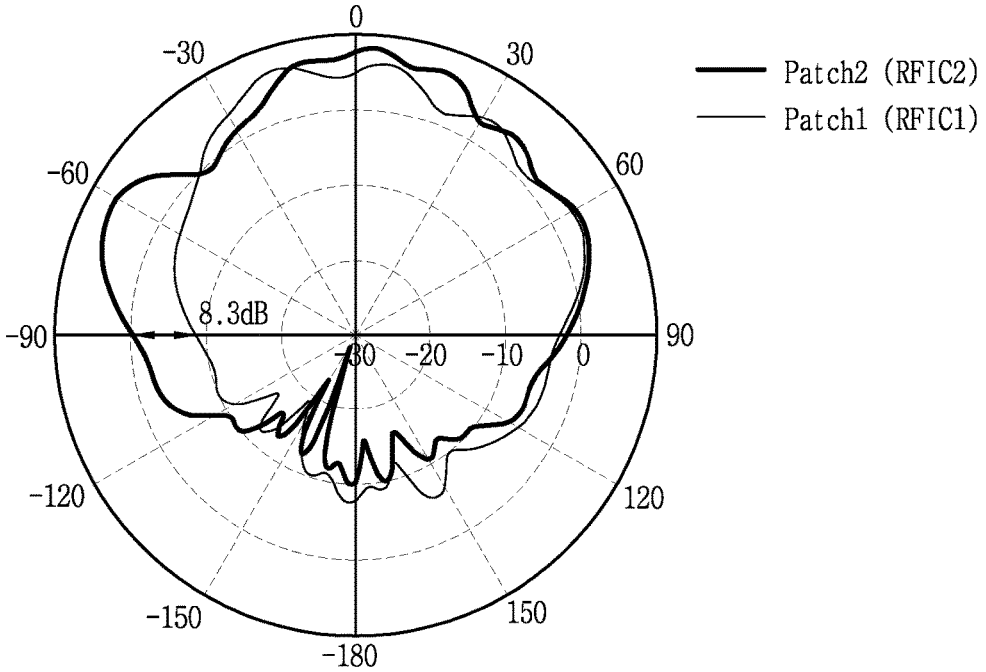
FIG. 7A is a view illustrating a radiation pattern on a y-z plane in a structure in which two array antennas according to the present disclosure are disposed in different positions of a display unit.
Figure 7A:
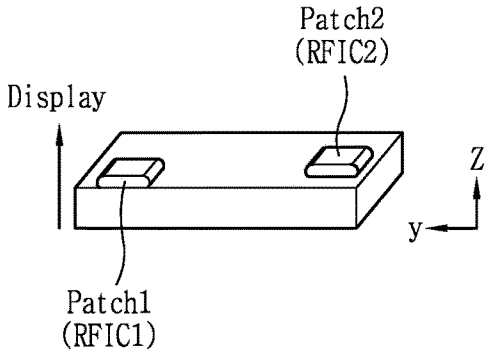
Figure 7B:
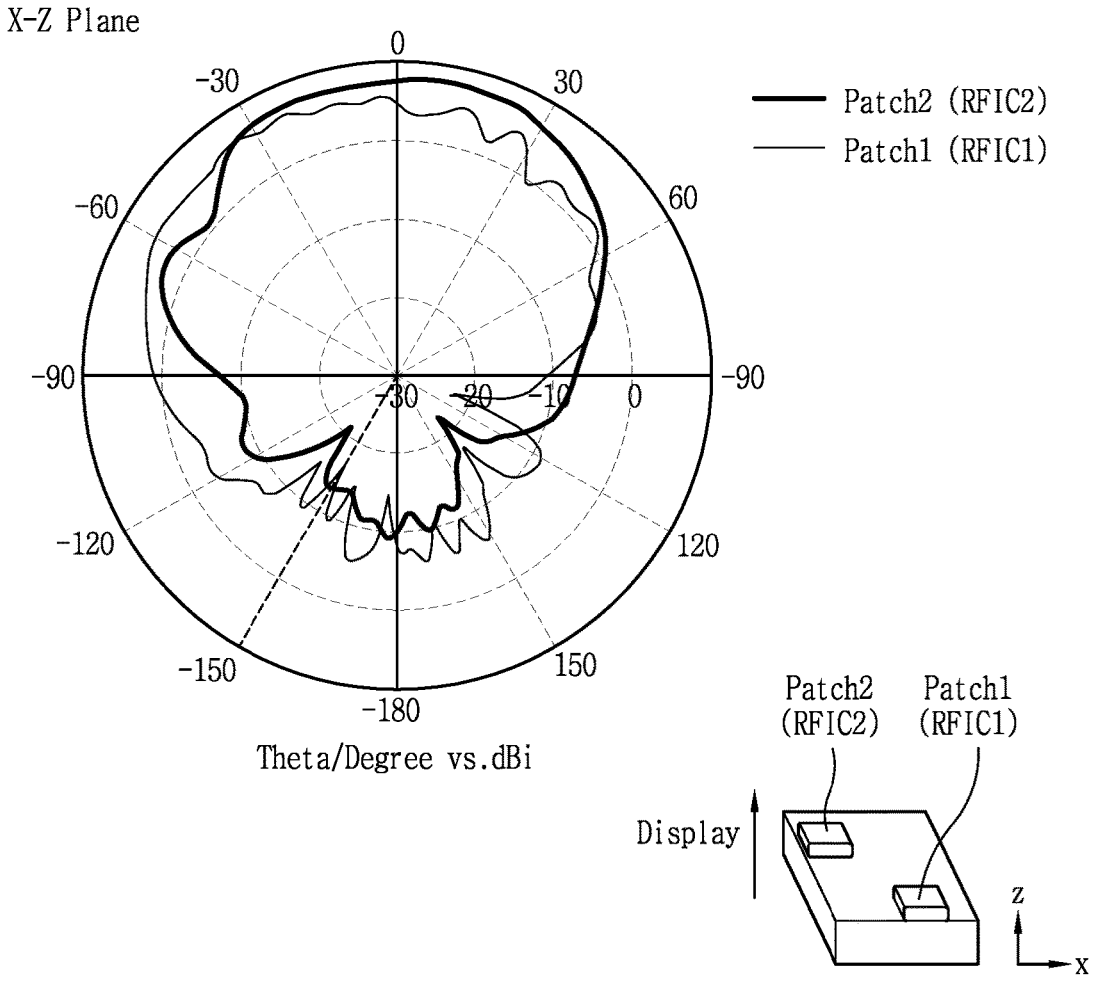
FIG. 7B is a view illustrating a radiation pattern on a x-z plane in a structure in which two array antennas according to the present disclosure are disposed in different positions of a display unit.

In particular, FIGS. 7A and 7B illustrate a radiation pattern on a y-z plane and a radiation pattern on an x-z plane in a structure in which two array antennas according to the present disclosure are arranged at different positions on the display unit. Referring to FIGS. 7A, 7B and 3, a first array antenna 300 (patch 1) is disposed on a right lower end of the display unit 151, and a second array antenna 300' (patch 2) is disposed on a left upper end. This arrangement minimizes an influence between the first and second array antennas 300 and 300' for MIMO or a diversity operation. In the x-y plane perpendicular to the display unit 151, radiation patterns of the first and second array antennas 300 and 300' are substantially similar.

However, referring to FIG. 7A, it can be seen that, in the y-z plane, a gain value of the second array antenna 300' is greater than a gain value of the first array antenna 300. Further, referring to FIG. 7B, it can be seen that, in the x-z plane, a gain value of the first array antenna 300 is greater than a gain value of the second array antenna 300'.

Therefore, the first and second array antennas 300 and 300' implemented in the display unit 151 have radiation patterns improved in a plane parallel to the display unit 151 as compared with an antenna installed within the electronic device. However, in the y-z plane, it is advantageous to use the second array antenna 300' disposed at the left upper end of the display unit 151, and in the x-z plane, it is advantageous to use the first array antenna 300.

An electromagnetic wave component on the y-z plane or the x-z plane may be dominant, depending on a rotation of the electronic device or an electromagnetic wave environment. Therefore, when the electromagnetic wave component on the plane parallel to the display unit 151 is dominant, the electromagnetic wave receiving characteristics can be improved according to the following diversity operation. For example, when the electromagnetic wave component in the y-z plane dominates, electromagnetic waves are received through the second array antenna 300', and when the propagation component in the X-Z plane dominates, electromagnetic waves can be received through the first array antenna 300.

The controller 180 controls the first and second array antennas 300 and 300' to transmit and receive signals therethrough. Here, the first and second array antennas 300 and 300' are connected to a first RFIC and a second RFIC, respectively.

The controller 180 can control both the first and second RFICs to operate to combine first and second signals. Alternatively, the controller 180 can transmit and receive only any one of the first and second signals based on a reception level (i.e., SNR or SINR level) in the first and second array antennas 300 and 300'. That is, the controller 180 can perform control to operate only any one of the first and second RFICs based on a signal reception level in the first and second array antennas 300 and 300'.

For example, the controller 180 can perform control to operate the first RFIC when the electronic device is disposed in a first direction and to operate the second RFIC when the electronic device is disposed in a second direction perpendicular to the first direction. The controller 180 can determine a direction in which the electronic device is disposed as sensed by the sensing unit 140.

Accordingly, the controller 180 can determine which of the first and second RFICs is to operate without any separate operation for determining a reception level, or the like, in the first and second array antennas 300 and 300'. Operating only any one of the first and second RFICs, the controller 180 can maintain communication performance by selecting an array antenna having excellent radiation performance, while reducing power consumption.

Figure 8A:
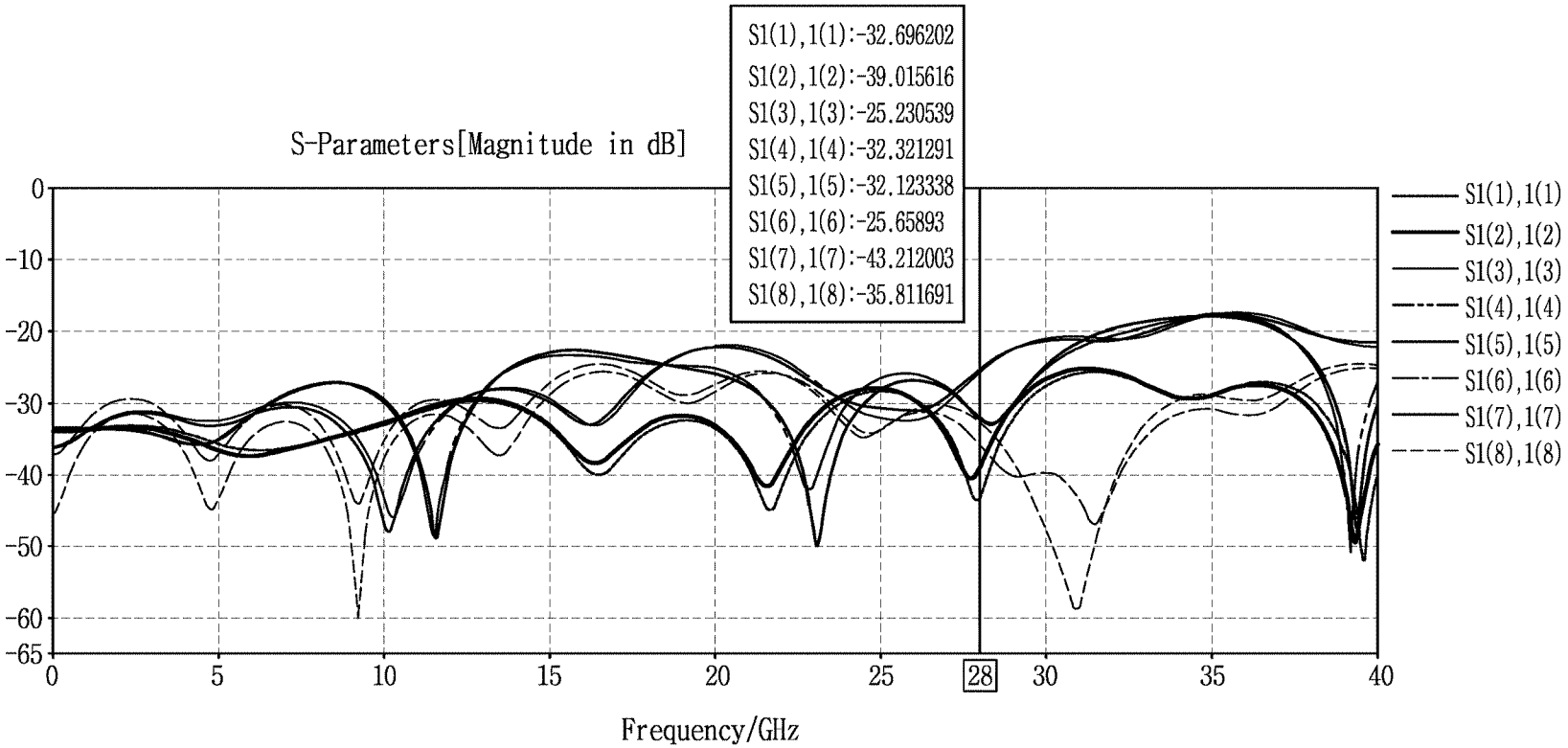
FIGS. 8A to 8D are views illustrating a reflection coefficient and a coefficient of transmission of a feeding line, and reflection coefficient characteristics of an antenna according to the present disclosure.
Figure 8B:
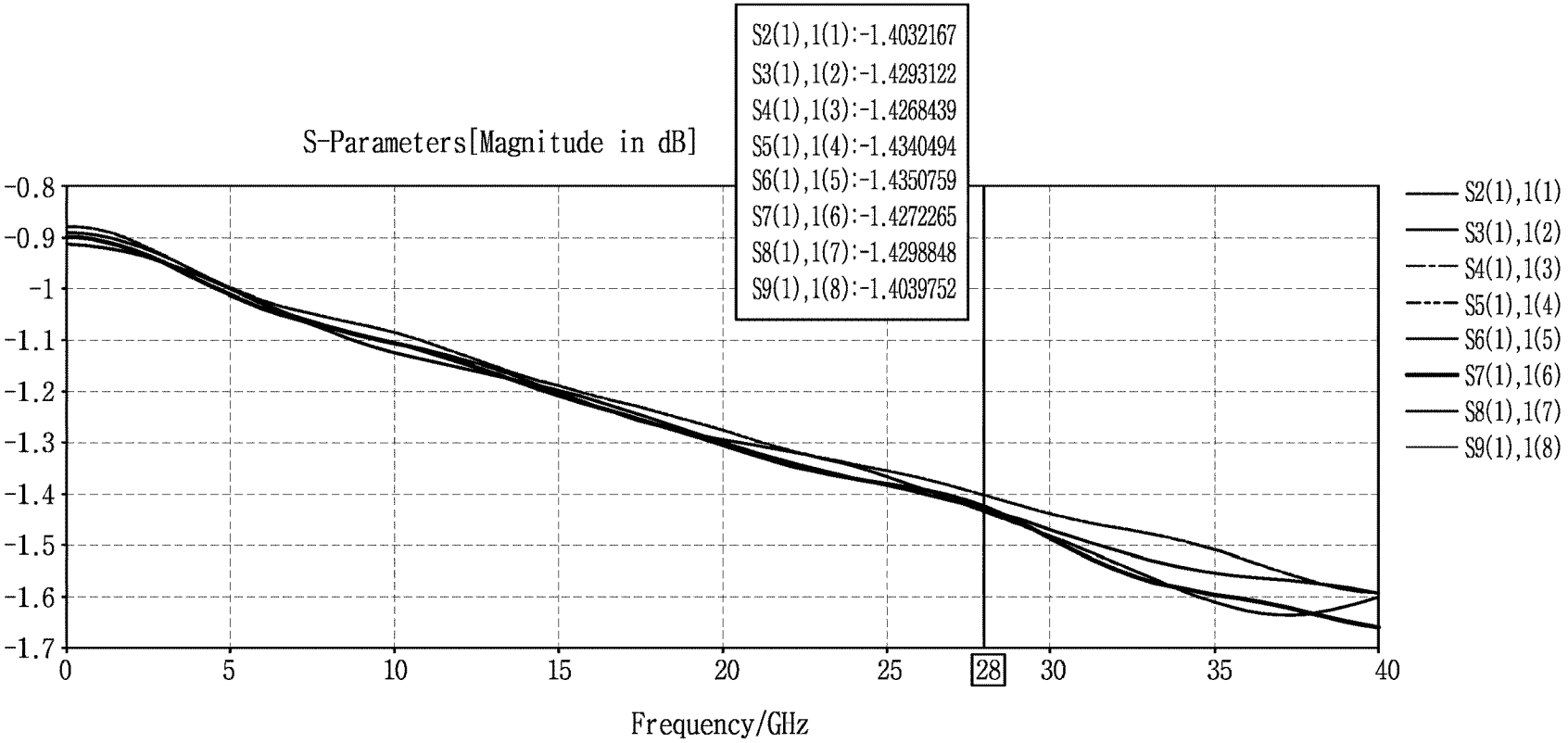
Figure 8C:
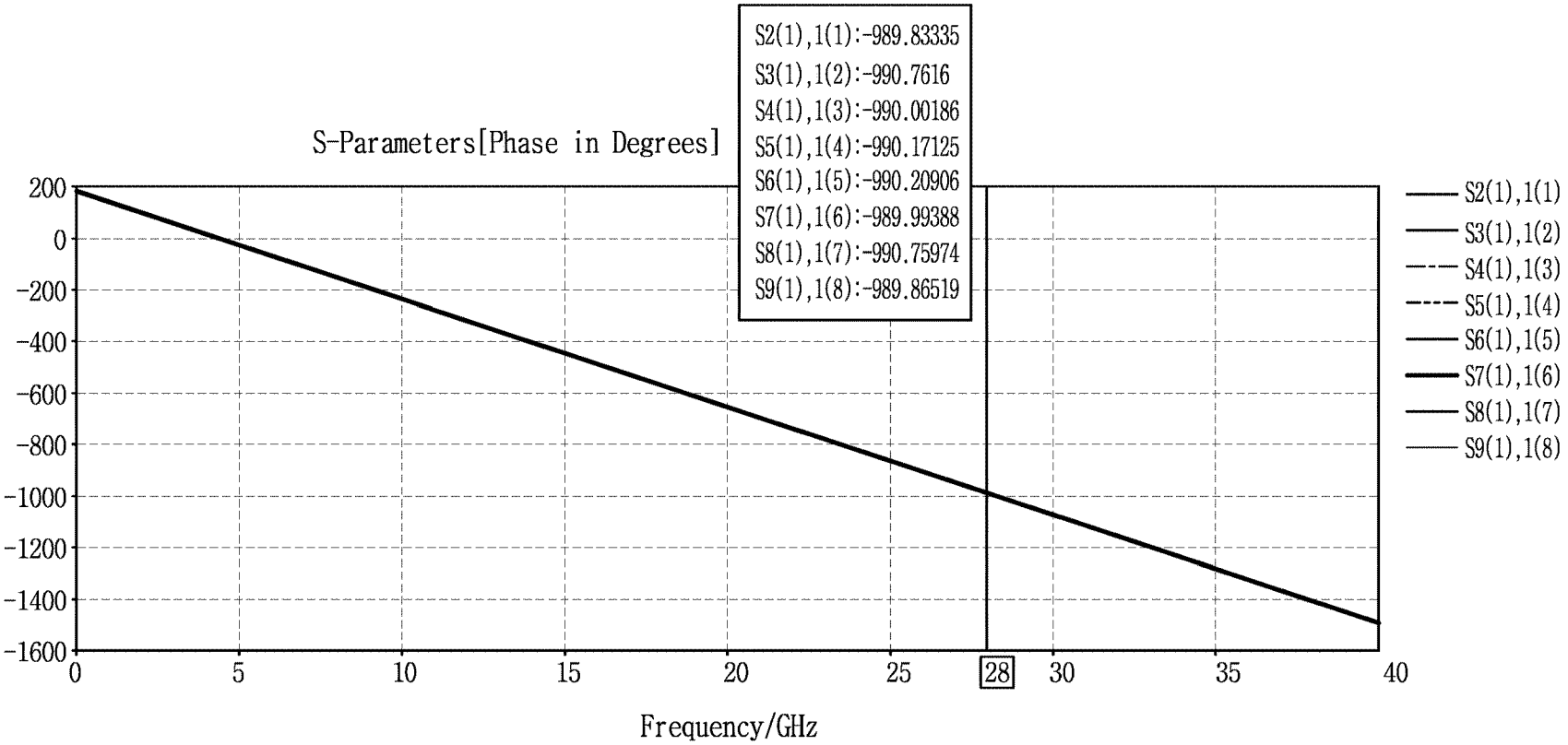

Next, FIGS. 8A to 8D illustrate reflection coefficients and transmission coefficients of a feeding line and reflection coefficient characteristics of an array antenna according to the present disclosure. In more detail, FIG. 8A illustrates a return loss of a feeding line according to an embodiment of the present invention by dB values, FIG. 8B illustrates an insertion loss of the feeding line by dB values, FIG. 8C illustrates a phase difference between a plurality of feeding lines.

FIG. 8A illustrates the feeding line has a return loss of −25 dB or less in the 28 GHz band. Also, FIG. 8B illustrates a good insertion loss of about 1.4 dB in the feeding line is maintained constant between the ports. The desirable constant insertion loss characteristics are because each feeding line connects the antenna elements and the RFICs in a one-to-one manner by the equal length without a power divider.

Figure 8D:
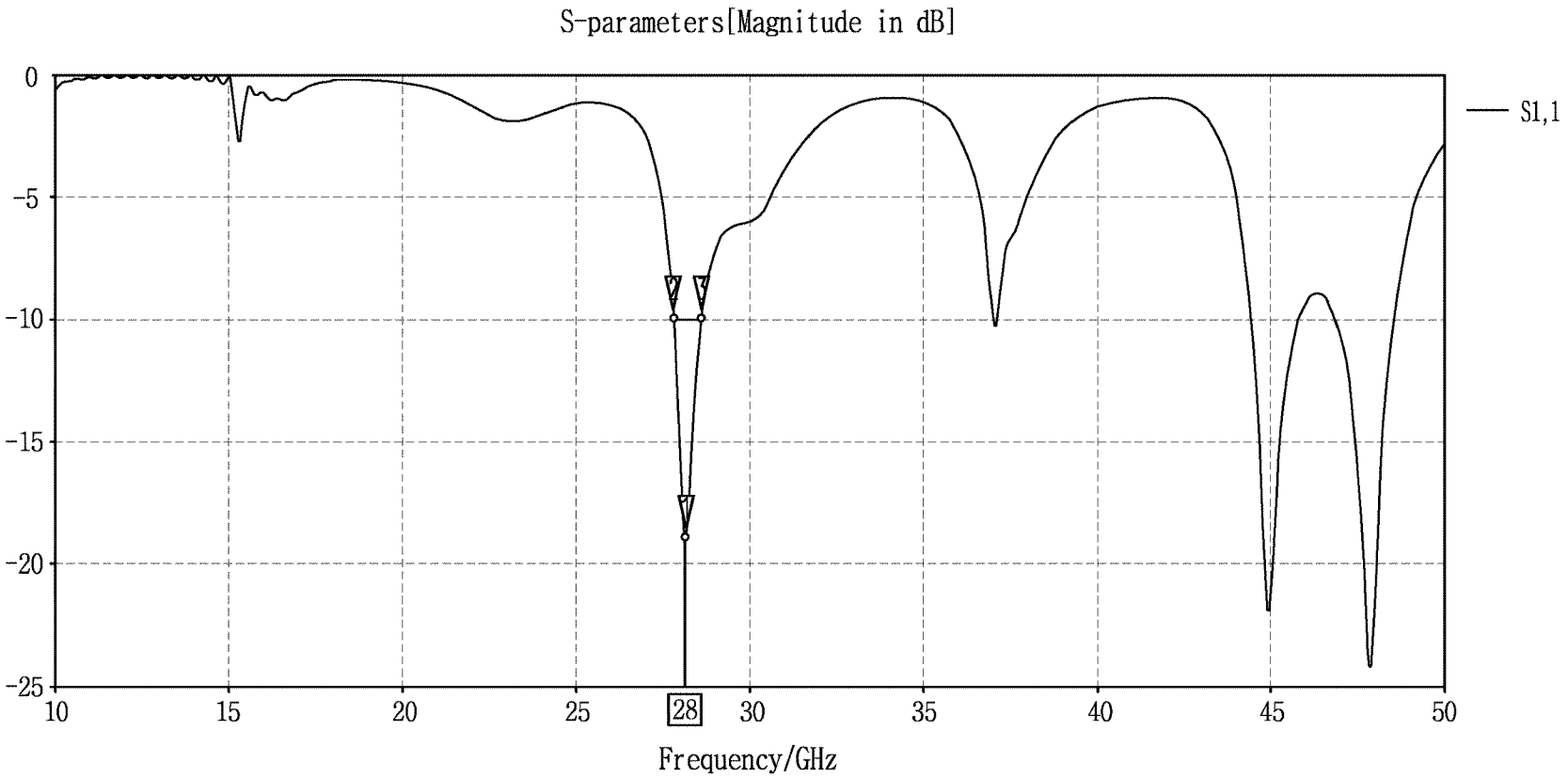

Also, FIG. 8C illustrates a phase difference between the feeding lines is maintained within 1 degree in a desired frequency band. This is because the feeding lines connecting each antenna element and each port of the RFIC are implemented with the same electrical length. In addition, FIG. 8D illustrates return loss characteristics of an array antenna when a power divider is used. The array antenna exhibits good return loss characteristics of −20 dB at 28 GHz and good return loss characteristics of less than −10 dB in this frequency band.

In the above, the electronic device including an antenna formed of a transparent electrode material in the display unit has been described. According to an embodiment of the present invention, the array antenna formed of a transparent electrode material in the display unit is provided to improve antenna performance in a next generation communication service. In addition, there is an advantage that loss due to dual-feeding of the array antenna formed of a transparent electrode material inside the display is reduced. In addition, since the array antenna forming of a transparent electrode material inside the display is double-fed, horizontal/vertical polarization purity can be maintained at the same level, thus preventing a variation in performance according to a rotational state of the electronic device.

The present invention described above may be implemented as a computer-readable code in a medium in which a program is recorded. The computer-readable medium includes any type of recording device in which data that may be read by a computer system is stored. The computer-readable medium may be, for example, a hard disk drive (HDD), a solid state disk (SSD), a silicon disk drive (SDD), a ROM, a RAM, a CD-ROM, a magnetic tape, a floppy disk, an optical data storage device, and the like. The computer-readable medium also includes implementations in the form of carrier waves (e.g., transmission via the Internet). Also, the computer may include the controller 180 of the terminal. Thus, the foregoing detailed description should not be interpreted limitedly in every aspect and should be considered to be illustrative. The scope of the present invention should be determined by reasonable interpretations of the attached claims and every modification within the equivalent range are included in the scope of the present invention.

The foregoing embodiments and advantages are merely exemplary and are not to be considered as limiting the present disclosure. The present teachings may be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. An electronic device comprising:

a display unit;

an array antenna including a transparent electrode material and being disposed within the display unit; and a radio frequency integrated circuit (RFIC) electrically connected to the array antenna, wherein the array antenna includes:

an antenna element having first and second sides perpendicular to each other disposed slopingly at a predetermined angle with respect to one side of the display unit; and a feeding part connecting the antenna element and the RFIC, and wherein the RFIC is disposed on a flexible printed circuit board (FPCB) connecting the display unit and a circuit board in order to reduce signal losses due to a reduction in an electrical length between the array antenna and the RFIC, and wherein the RFIC is mounted on the circuit board, and the RFIC and the array antenna have electrical connection by the FPCB connecting without a connector between the feeding part and the RFIC.

2. The electronic device of claim 1, wherein the display unit includes:

an output region for displaying information; and an opaque bezel region surrounding the output region, and wherein the antenna element is disposed within the output region of the display unit.

3. The electronic device of claim 2, wherein the first and second sides are disposed to slope at +45° and −45° with respect to a boundary between the output region and the bezel region, respectively.

4. The electronic device of claim 2, wherein the feeding part includes:

a first feeding part connected to the antenna element in the output region; and a second feeding part connected to the first feeding part in the bezel region, and wherein the second feeding part is configured as at least one power divider connecting adjacent first feeding parts.

5. The electronic device of claim 2, wherein the antenna element includes a plurality of antenna elements arranged in one direction, wherein the feeding part includes a plurality of feeding parts corresponding to the plurality of antenna elements, and wherein each of the plurality of feeding parts is connected to a single port of the RFIC in a one-to-one manner.

6. The electronic device of claim 5, wherein the plurality of feeding parts have a same length.

7. The electronic device of claim 6, wherein as a distance between the plurality of antenna elements and the RFIC is shorter, a number of bends of the feeding part increases.

8. The electronic device of claim 1, wherein the feeding part includes first and second feeding lines linearly disposed to be parallel to each other, wherein the antenna element is disposed on a first layer and the first and second feeding lines are disposed on a second layer below the first layer, wherein electrical signals from the first and second feeding lines are slot-coupled to the antenna element through a slot in which a ground pattern is removed on a ground plane on a third layer between the first and second layers, and wherein the first layer, the second layer and the third layer is disposed in the display unit.

9. The electronic device of claim 8, wherein the first feeding line is connected to a middle point of the first side, and the second feeding line is connected to a middle point of the second side.

10. The electronic device of claim 9, wherein the first feeding line and the second feeding line have a same length.

11. The electronic device of claim 1, wherein the feeding part is a single feeding line connected to a vertex where the first and second sides meet.

12. The electronic device of claim 1, wherein the antenna element is between a cover window and a polarizer of the display unit or between the polarizer and a touch electrode layer of the display unit.

13. The electronic device of claim 12, wherein the antenna element is a nanosilver or a nanowire.

14. The electronic device of claim 1, wherein the array antenna includes a plurality of array antennas spaced apart from each other, and wherein the electronic device further includes a controller configured to implement beamforming by changing a phase of a signal applied to each of the plurality of array antennas.

15. The electronic device of claim 14, wherein the plurality of array antennas include:

a first array antenna disposed at a lower end of one side of the display unit and connected to a first RFIC; and a second array antenna disposed at an upper end of the other side of the display unit and connected to a second RFIC, and wherein the controller operates one of the first and second RFICs based on a signal reception level in the first and second array antennas.

16. The electronic device of claim 14, wherein the plurality of array antennas include:

a first array antenna disposed at a lower end of one side of the display unit and connected to a first RFIC; and a second array antenna disposed at an upper end of the other side of the display unit and connected to a second RFIC, and wherein the controller operates the first RFIC when the electronic device is disposed in a first direction, and operates the second RFIC when the electronic device is disposed in a second direction perpendicular to the first direction.

17. An electronic device comprising:

a display unit including an output region for displaying information and an opaque bezel region surrounding the output region;

an array antenna including a transparent electrode material and disposed within the output region; and a radio frequency integrated circuit (RFIC) electrically connected to the array antenna, wherein the array antenna includes:

an antenna element; and first and second feeding lines connecting the antenna element and the RFIC in a dual-feeding form and linearly disposed to be parallel to each other, and wherein the RFIC is disposed on a flexible printed circuit board (FPCB) connecting the display unit and a circuit board in order to reduce signal losses due to a reduction in an electrical length between the array antenna and the RFIC, and wherein the RFIC is mounted on the circuit board, the RFIC and the array antenna has electrical connection by the FPCB connecting without a connector between the feeding part and the RFIC.

18. The electronic device of claim 17, wherein the first feeding line and the second feeding line have a same length.

19. The electronic device of claim 17, wherein the array antenna is a nanosilver or a nanowire.

* * * * *